US011717456B2

(12) United States Patent
Linde

(10) Patent No.: US 11,717,456 B2
(45) Date of Patent: Aug. 8, 2023

(54) SUPPORT HARNESSES, SYSTEMS, AND KITS FOR LIFTING AND/OR ROTATING A SUBJECT USING AN OVERHEAD LIFT

(71) Applicant: LIKO RESEARCH & DEVELOPMENT AB, Luleå (SE)

(72) Inventor: Marcus Linde, Öjebyn (SE)

(73) Assignee: LIKO RESEARCH & DEVELOPMENT AB, Luleå (SE)

( * ) Notice: Subject to any disclaimer, the term of this patent is extended or adjusted under 35 U.S.C. 154(b) by 135 days.

(21) Appl. No.: 17/308,661

(22) Filed: May 5, 2021

(65) Prior Publication Data

US 2021/0361503 A1 Nov. 25, 2021

Related U.S. Application Data

(60) Provisional application No. 63/027,636, filed on May 20, 2020.

(51) Int. Cl.
*A61G 7/10* (2006.01)

(52) U.S. Cl.
CPC ..... *A61G 7/1051* (2013.01); *A61G 7/1063* (2013.01)

(58) Field of Classification Search
CPC .. A61G 7/1051; A61G 7/1063; A61G 7/1042; A61G 7/1061
See application file for complete search history.

(56) References Cited

U.S. PATENT DOCUMENTS 1,536,766 A * 5/1925 Cammann ..... A61G 7/1015 212/326
1,541,938 A * 6/1925 Frederick ..... A61G 7/1015 5/89.1
1,876,832 A * 9/1932 Bancroft ..... A61G 7/1055 5/89.1
2,376,560 A * 5/1945 Smith ..... A61G 7/1067 212/343
2,603,851 A * 7/1952 Hawkins ..... A61G 7/1015 254/296

(Continued)

FOREIGN PATENT DOCUMENTS

EP 1452155 A2 * 9/2004 ..... A61F 5/028
GB 2531913 A * 5/2016 ..... A61G 7/1015

(Continued)

*Primary Examiner* — David R Hare
*Assistant Examiner* — Alexis Felix Lopez
(74) *Attorney, Agent, or Firm* — Dinsmore & Shohl LLP

(57) ABSTRACT

Support harnesses and systems and kits including the same are disclosed. A support harness includes a plurality of straps arranged such that a first strap, a second strap, and a third strap are spaced apart from one another, and the third strap extends between the first strap and the second strap. The support harness further includes a first connection piece extending between a proximal end of the first strap and a proximal end of the third strap and a second connection piece extending between a proximal end of the second strap and the proximal end of the third strap. The first strap, the second strap, and the third strap are each positionable around a horizontally positioned subject by wrapping the respective distal ends around a body part of the horizontally positioned subject and coupling the distal ends to the respective portions.

20 Claims, 10 Drawing Sheets

(56) References Cited

U.S. PATENT DOCUMENTS

| | | | | | |
|---|---|---|---|---|---|
| 2,918,718 | A * | 12/1959 | Oberwegner | A61G 7/1015 | 294/81.1 |
| 4,195,375 | A * | 4/1980 | Paul | A61G 7/1046 | 5/87.1 |
| 4,903,355 | A | 2/1990 | Hickerson | | |
| 5,068,931 | A * | 12/1991 | Smith | A61G 7/1046 | 5/84.1 |
| 5,263,495 | A | 11/1993 | Butterfield | | |
| 5,315,723 | A * | 5/1994 | Smith | A61G 7/1015 | D12/132 |
| 6,092,525 | A | 7/2000 | Church | | |
| 6,532,607 | B1 * | 3/2003 | Heil | A61G 7/1042 | 212/250 |
| 6,578,210 | B2 | 6/2003 | Erickson | | |
| 8,321,972 | B1 | 12/2012 | Vetter | | |
| 8,555,432 | B2 | 10/2013 | Lavin | | |
| 9,988,245 | B2 | 6/2018 | Schroeder | | |
| 10,258,527 | B2 | 4/2019 | Rodriguez | | |
| 2018/0036187 | A1 * | 2/2018 | Bux | A61G 7/0507 | |
| 2018/0185226 | A1 | 7/2018 | Rydstrom et al. | | |

FOREIGN PATENT DOCUMENTS

| | | | | |
|---|---|---|---|---|
| WO | WO-2009076698 | A1 * | 6/2009 | A61G 7/0536 |
| WO | WO-2019213785 | A1 * | 11/2019 | A61F 5/028 |

* cited by examiner

SUPPORT HARNESSES, SYSTEMS, AND KITS FOR LIFTING AND/OR ROTATING A SUBJECT USING AN OVERHEAD LIFT

CROSS-REFERENCE TO RELATED APPLICATION

The present application claims the priority benefit of U.S. Provisional Application Ser. No. 63/027,636, entitled "SUPPORT HARNESSES, SYSTEMS, AND KITS FOR LIFTING AND/OR ROTATING A SUBJECT USING AN OVERHEAD LIFT" and filed May 20, 2020, the entire contents of which is incorporated by reference herein.

BACKGROUND

Field

The present specification generally relates to support harnesses and, more specifically, to support harnesses having a plurality of support strap members that are particularly placed on a subject for the purposes of positioning and rotating the subject using an overhead lift.

Technical Background

Subjects that are supported by a surface for long periods of time can develop injuries such as pressure ulcers or the like if contact between the subject's body and the surface is not periodically adjusted. One means of adjusting contact is rotating the subject from a prone position to a supine position, and vice versa. In addition, rotating the subject from a prone position to a supine position, and vice versa, may be necessary for the purposes of treating various diseases and conditions that affect the respiratory system, including, but not limited to, acute respiratory distress syndrome (ARDS), coronavirus disease (COVID-19), or the like. However, some subjects cannot move themselves between positions because of, for example, unconsciousness of the subject, physical deformity of the subject, size of the subject, and/or the like.

Various apparatuses exist to rotate subjects, but such apparatuses tend to be large, unwieldy, not easily transported, expensive, and not readily available. Further, use of standard lifting aids with an overhead lift such as the Liko® MultiStrap™ lift aid (available from Hillrom of Batesville, Ind.) may not be intuitive for users to determine how exactly to position a subject with respect to the lifting aid and/or how to position the lifting aid on the overhead lift to achieve the correct rotation. As an alternative, medical personnel use various techniques to rotate a subject from a prone position to a supine position, and vice versa, such as, for example, utilizing bed sheets or the like, pushing and pulling on the subject, and/or the like. Such techniques may require a large number of medical personnel, may result in injury or incorrect positioning of the subject, may result in injury to the medical personnel, and/or the like.

SUMMARY

In a first aspect A1, a support harness having features to aid in lifting or rotating a horizontally positioned subject includes a plurality of straps that include a first strap having a distal end and a proximal end, the first strap having connection features that connect the distal end to a portion of the first strap, a second strap having a distal end and a proximal end, the second strap having connection features that connect the distal end to a portion of the second strap, and a third strap having a distal end and a proximal end, the third strap having connection features that connect the distal end to a portion of the third strap, the plurality of straps arranged such that the first strap, the second strap, and the third strap are spaced apart from one another, and the third strap extends between the first strap and the second strap. The support harness further includes a first connection piece extending between the proximal end of the first strap and the proximal end of the third strap, the first connection piece coupling the first strap to the third strap. The support harness further includes a second connection piece extending between the proximal end of the second strap and the proximal end of the third strap, the second connection piece coupling the first strap to the third strap. The first strap, the second strap, and the third strap are each positionable around the horizontally positioned subject by wrapping the respective distal ends around a body part of the horizontally positioned subject and coupling the distal ends to the respective portions.

A second aspect A2 includes the first aspect A1, wherein the connection features of the first strap, the connection features of the second strap, and the connection features of the third strap each comprise portions of a hook-and-loop fastener.

A third aspect A3 includes the first aspect A1, wherein the connection features of the first strap, the connection features of the second strap, and the connection features of the third strap each comprise a connector that is couplable to connection points located on the first strap, the second strap, and the third strap.

A fourth aspect A4 includes the third aspect A3, wherein the connector is a shackle, a carabiner, a buckle, a clamp, a clasp, a hook, a latch, or a tie.

A fifth aspect A5 includes the third aspect A3 or fourth aspect A4, wherein the connection points include a first strip of material coupled to the first strap, a second strip of material coupled to the second strap, and a third strip of material coupled to the third strap, each of the first strip of material, the second strip of material, and the third strip of material forming banded loops that are shaped and sized to receive a respective connector.

A sixth aspect A6 includes the third aspect A3 or fourth aspect A4, wherein the connection points include a plurality of through holes disposed on each of the first strap, the second strap, and the third strap, the plurality of through holes shaped and sized to receive a respective connector.

A seventh aspect A7 includes any one of the first-sixth aspects A1-A6, further including a first loop extending from the proximal end of the first strap and a second loop extending from the proximal end of the second strap, the first loop and the second loop each providing a connection point with a sling bar.

An eighth aspect A8 includes any one of the first-seventh aspects A1-A7, wherein the third strap extends in a system vertical direction, the first strap extends at a first angle relative to the system vertical direction, and the second strap extends at a second angle relative to the system vertical direction.

A ninth aspect A9 includes any one of the first-eighth aspects A1-A8, wherein a length of the first strap is substantially the same as a length of the second strap.

A tenth aspect A10 includes any one of the first-ninth aspects A1-A9, wherein a length of the third strap is longer than one or more of a length of the first strap and a length of the second strap.

An eleventh aspect A11 includes any one of the first-tenth aspects A1-A10, wherein each of the first strap, the second strap, and the third strap is constructed of a flexible material.

A twelfth aspect A12 includes any one of the first-eleventh aspects A1-A11, wherein each of the plurality of straps includes a first major surface constructed of or coated with a high-friction material and a second major surface constructed of or coated with a low-friction material, the low-friction material having a coefficient of friction that is lower than a coefficient of friction of the high-friction material, wherein the support harness is arranged such that the first major surfaces face the subject and the second major surface faces a support surface on which the subject is laying.

A thirteenth aspect A13 includes any one of the first-twelfth aspects A1-A12, further including indicia indicating an arrangement of the plurality of straps with respect to the subject.

A fourteenth aspect A14 includes any one of the first-thirteenth aspects A1-A13, further including at least one support plate positioned on at least one of the plurality of straps.

A fifteenth aspect A15 includes the fourteenth aspect A14, wherein the at least one support plate is removable from the at least one of the plurality of straps.

A sixteenth aspect A16 includes any one of the fourteenth-fifteenth aspects A14-A15, wherein the at least one support plate is positionable along a length of the at least one of the plurality of straps.

A seventeenth aspect A17 includes any one of the thirteenth-sixteenth aspects A13-A16, wherein the at least one support plate is a planar component having a first major surface and a second major surface opposite the first major surface, the first major surface comprising a support pad thereon, and the second major surface comprising a retention component, the retention component receiving the at least one of the plurality of straps.

An eighteenth aspect A18 includes the seventeenth aspect A17, wherein the support pad is constructed of a shock absorbing material.

A nineteenth aspect A19 includes any one of the thirteenth-eighteenth aspects A13-A18, wherein the at least one support plate is constructed of a rigid material that maintains a shape of the at least one support plate when pressed against the subject.

A twentieth aspect A20 includes any one of the thirteenth-nineteenth aspects A13-A19, wherein a width of a body of the at least one support plate is greater than a width of the at least one of the plurality of straps.

In a twenty-first aspect A21, a system includes an overhead lift, a sling bar coupled to the overhead lift, and the support harness of any one of the first-thirteenth aspects A1-A13.

A twenty-second aspect A22 includes the twenty-first aspect A21, further including at least one support plate positioned on at least one of the plurality of straps.

A twenty-third aspect A23 includes the twenty-first aspect A21 or the twenty-second aspect A22, further including a second support harness.

In a twenty-fourth aspect A24, a kit of parts includes the support harness of any one of the first-twentieth aspects A1-A20 and one or more instructions for positioning the support harness with respect to the subject.

A twenty-fifth aspect A25 includes the twenty-fourth aspect A24, further including a second support harness and one or more instructions for positioning the second support harness with respect to the subject.

In a twenty-sixth aspect A26, a method of arranging a horizontally laying subject includes providing the support harness of any one of the first-twentieth aspects A1-A20, arranging the third strap around a torso of the subject, and connecting the connection features of the third strap to secure the subject to the third strap.

A twenty-seventh aspect A27 includes the twenty-sixth aspect A26, further including arranging the first strap around a thigh of the subject and connecting the connection features of the first strap to secure the subject to the first strap.

A twenty-eighth aspect A28 includes the twenty-sixth aspect A26 or the twenty-seventh aspect A27, further including arranging the second strap around an arm of the subject, and connecting the connection features of the first strap to secure the subject to the first strap.

A twenty-ninth aspect A29 includes the twenty-sixth aspect A26, further including arranging the first strap around a first thigh of the subject and connecting the connection features of the first strap to secure the subject to the first strap, arranging the second strap around a second thigh of the subject and connecting the connection features of the first strap to secure the subject to the first strap, and arranging one or more straps of a second support harness around one or more arms of the subject and connecting connection features of one or more straps of the second support harness to secure the subject to the one or more straps of the second support harness.

A thirtieth aspect A30 includes the twenty-ninth aspect A29, further including arranging a strap of the second support harness around the torso of the subject and connecting connection features of the strap of the second support harness to secure the subject to the strap of the second support harness.

A thirty-first aspect A31 includes any one of the twenty-sixth-thirtieth aspects A26-A30, wherein the support harness further includes a first loop extending from the proximal end of the first strap and a second loop extending from the proximal end of the second strap, the method further comprising coupling the first loop and the second loop to the sling bar.

Additional features and advantages of the aspects described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
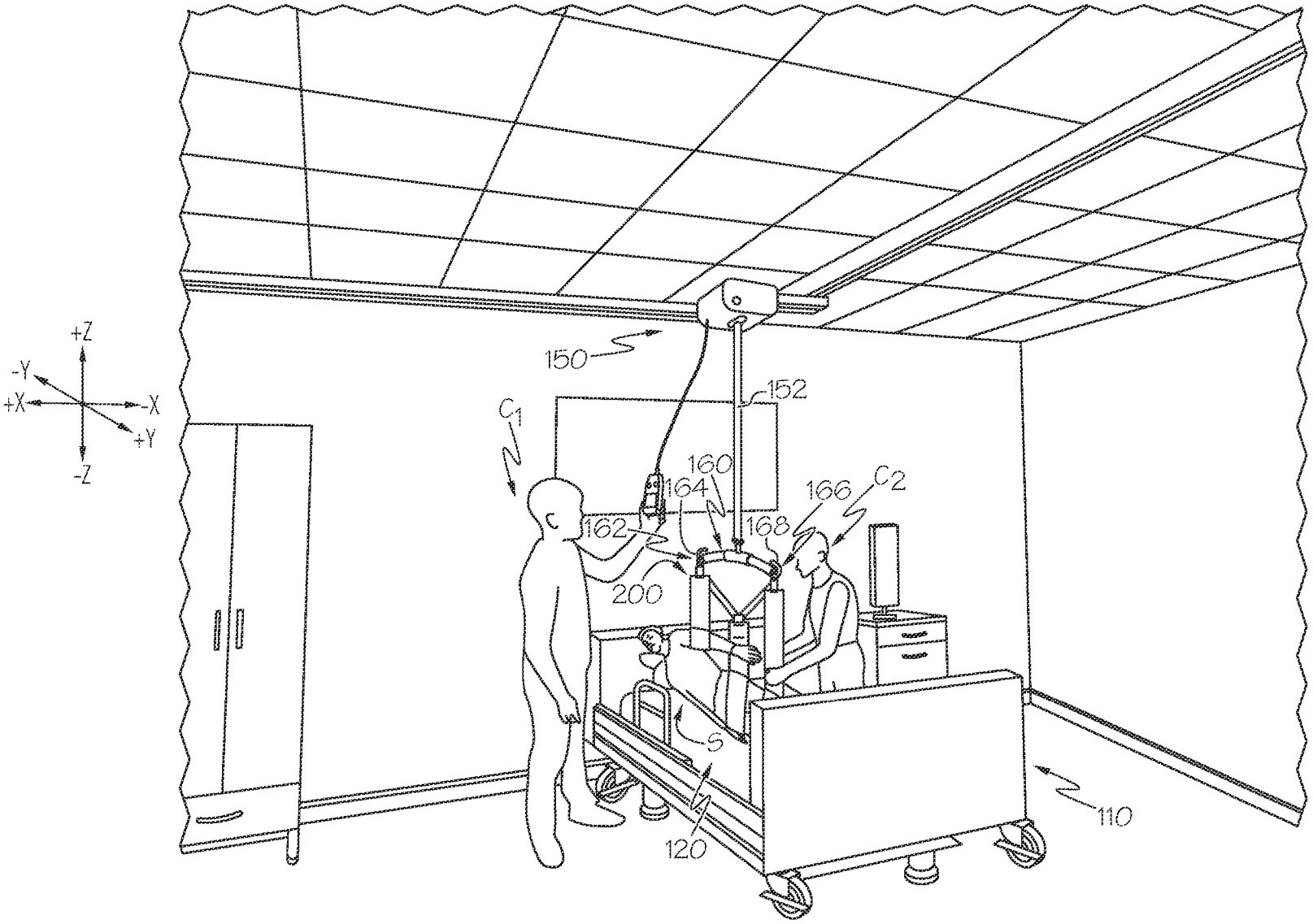
FIG. 1 depicts an illustrative scene of a plurality of individuals performing a rotating method on a subject using an overhead lift and a support harness according to one or more embodiments shown and described herein.
Figure 4A:
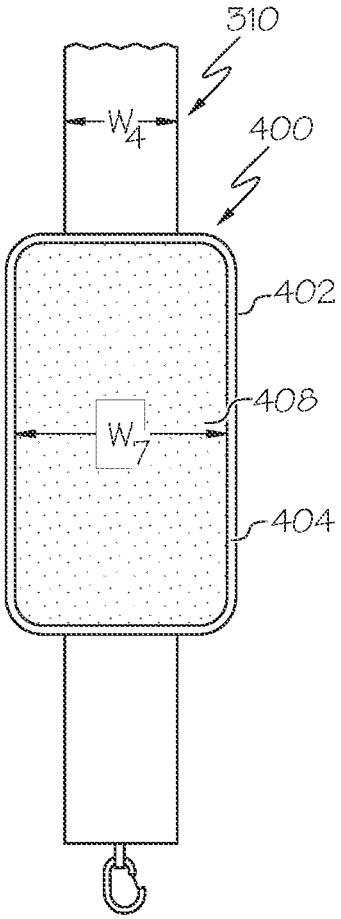
FIG. 4A depicts detailed view of an illustrative strap of a support harness coupled to a detachable support plate according to one or more embodiments shown and described herein.
Figure 4B:
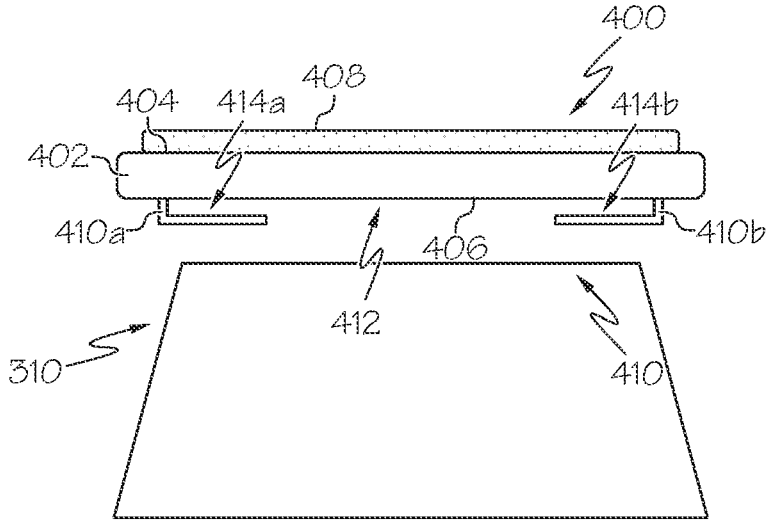
FIG. 4B depicts a side view of the illustrative strap of the support harness when detached from the detachable support plate of FIG. 4A according to one or more embodiments shown and described herein.
Figure 5:
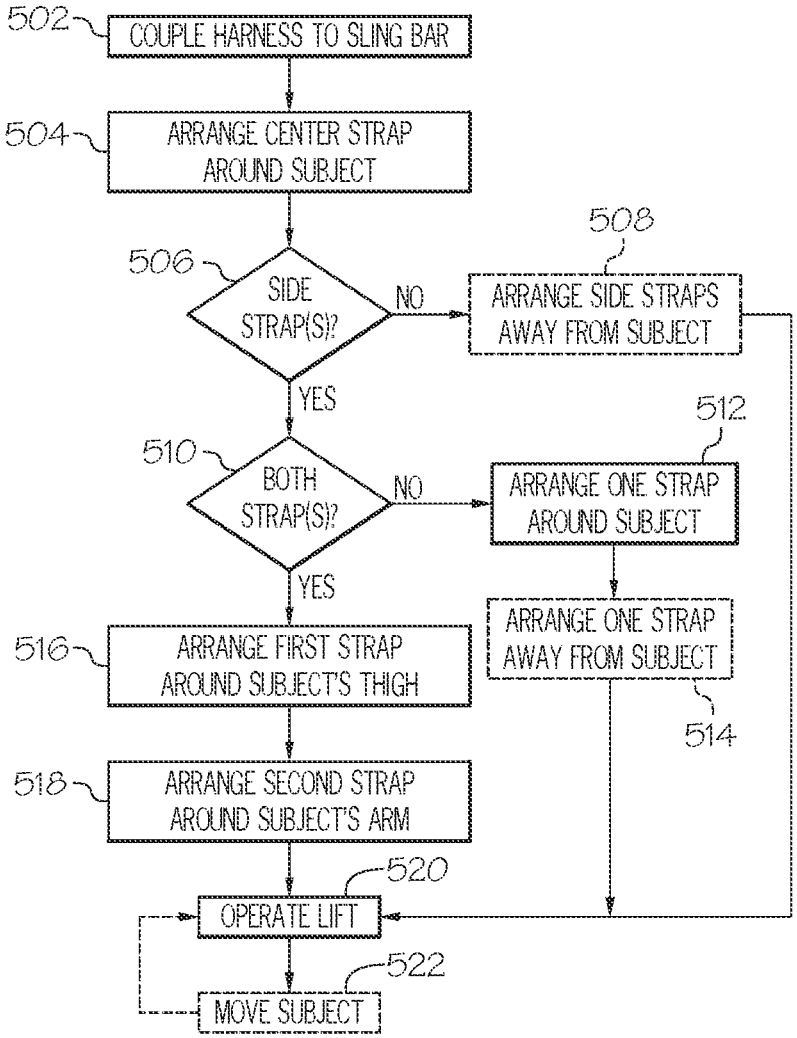
FIG. 5 depicts a flow diagram of an illustrative method of placing one or more support harnesses with respect to a subject and operating an overhead lift coupled to the one or more support harnesses according to one or more embodiments shown and described herein FIG. 6A schematically depicts a side perspective view of a subject supported by a support harness coupled to a sling bar according to one or more embodiments shown and described herein.
Figure 6A:
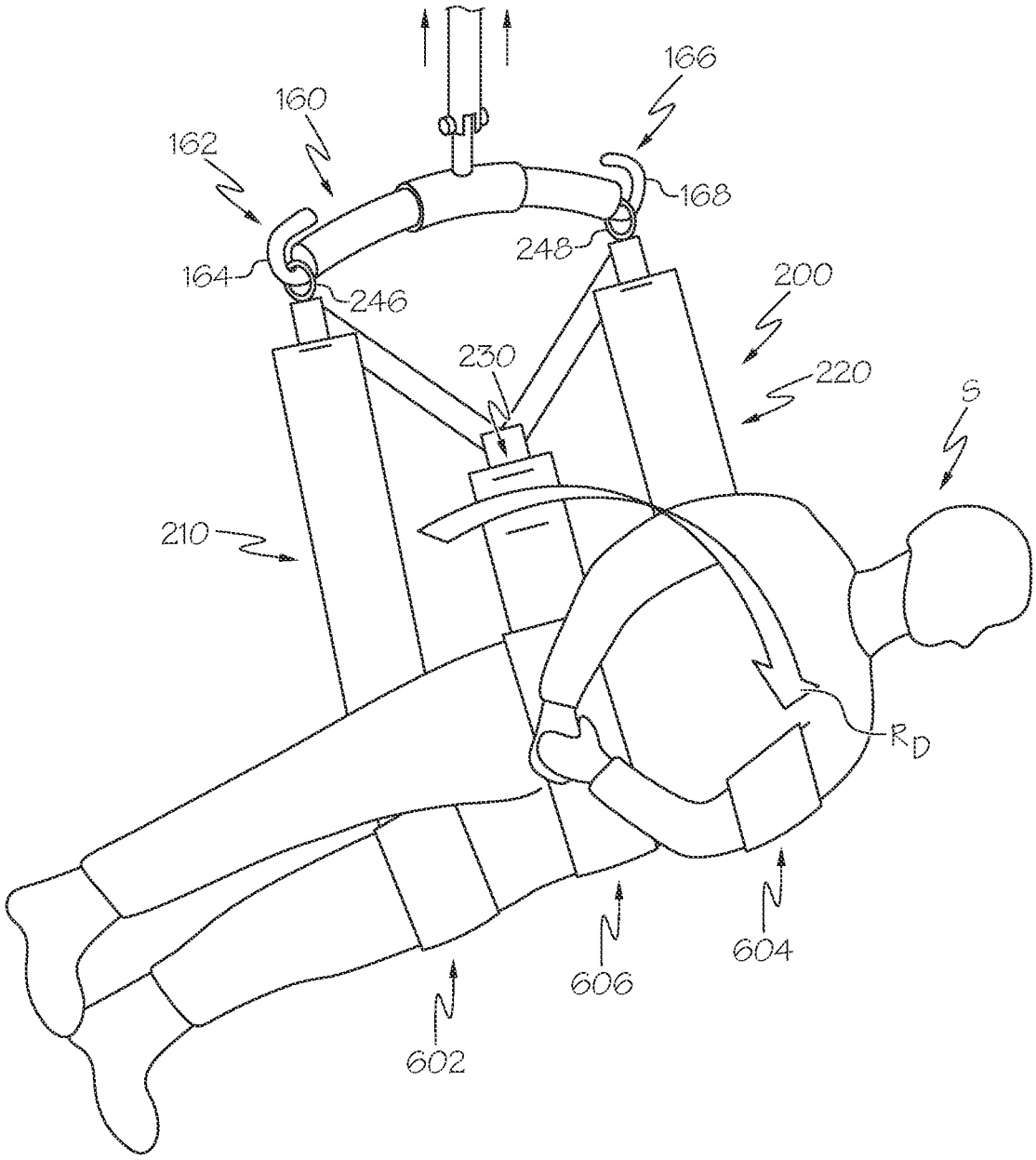
FIG. 6B schematically depicts a side perspective view of a subject supported by a pair of support harnesses coupled to a sling bar according to one or more embodiments shown and described herein.
FIG. 6C schematically depicts a top down view of a subject supported by a pair of support harnesses coupled to a sling bar according to one or more embodiments shown and described herein.
Figure 6B:
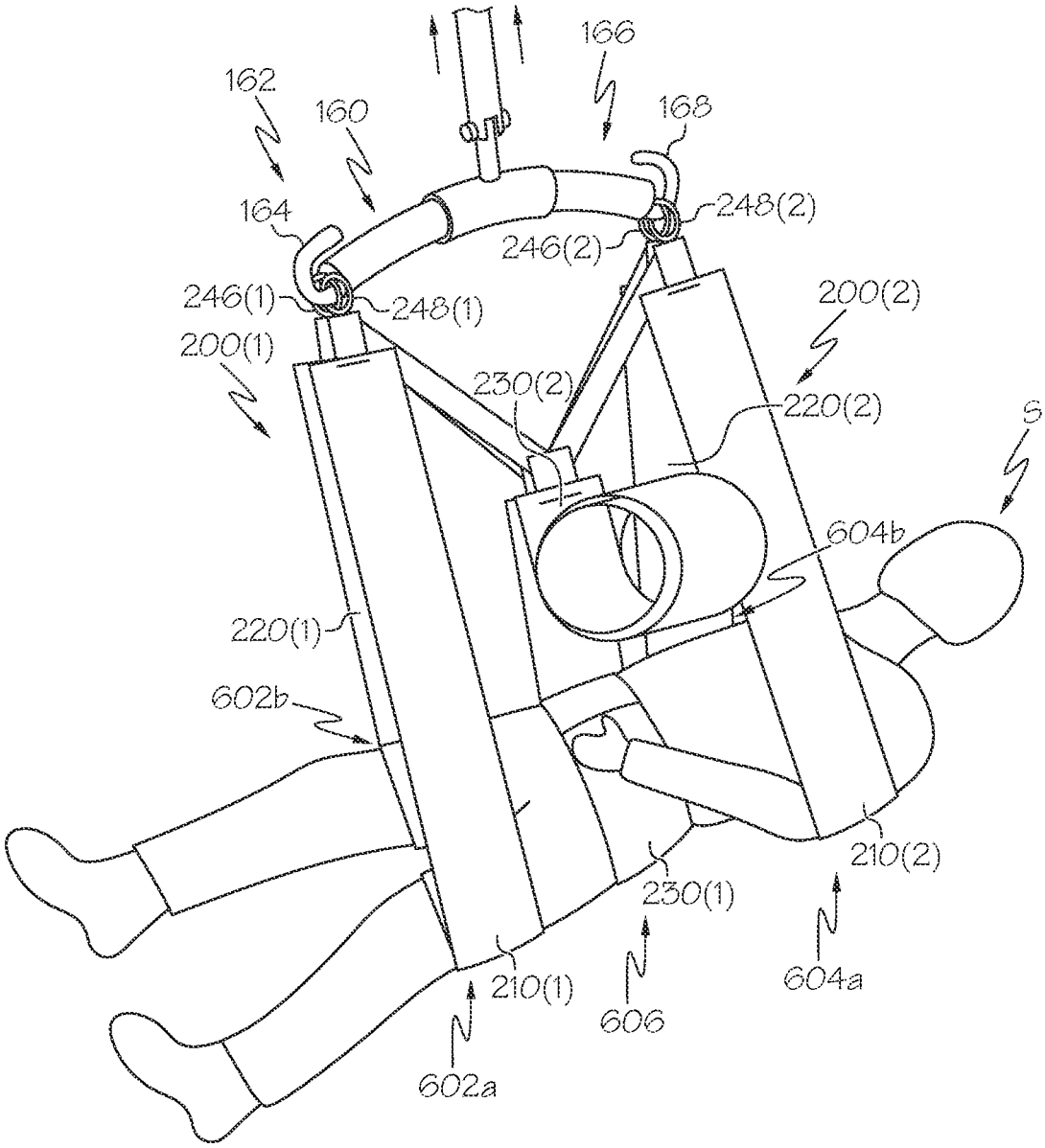
Figure 6C:
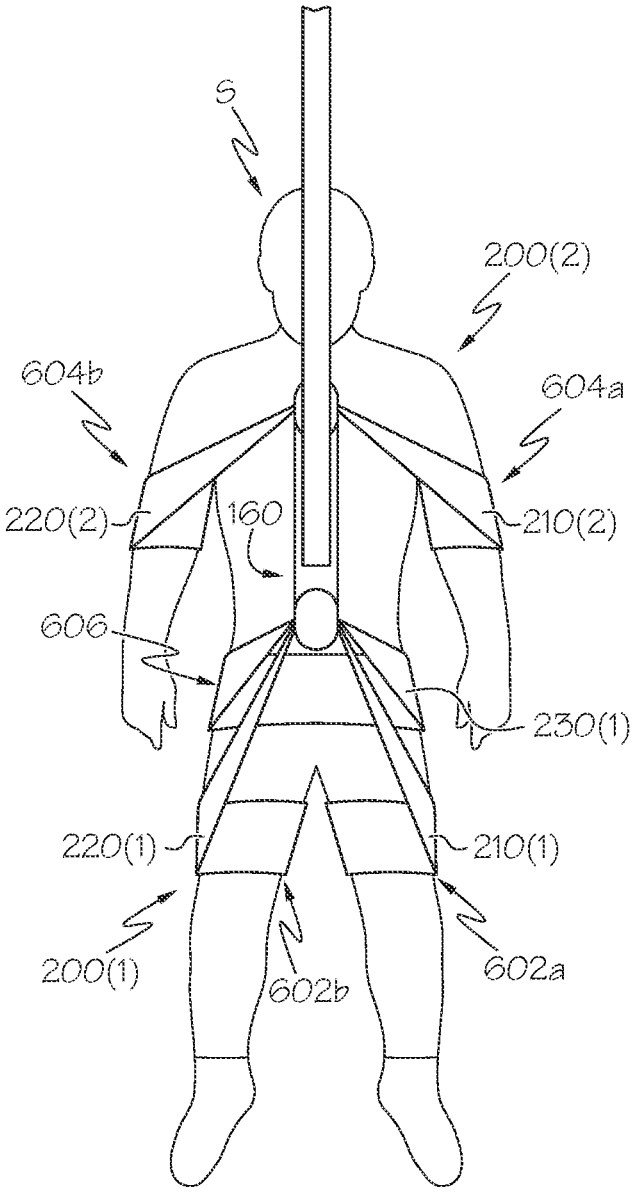

Reference will now be made in detail to various support harnesses that are customized for the purposes of manipulating a subject, such as raising/lowering a subject, rotating a subject from a prone position to a supine position, and/or rotating a subject from a supine position to a prone position using one or more overhead lifts, examples of which are illustrated in the accompanying drawings. Whenever possible, the same reference numerals will be used throughout the drawings to refer to the same or like parts. One embodiment of a lift system used for carrying out the various methods described herein is depicted in FIG. 1, in which the lift system includes at least one overhead lift and one or more support harnesses. FIGS. 2A-2D depict various illustrative connection features of one embodiment of a support harness and FIGS. 3A-3E depict various illustrative connection features of another embodiment of a support harness. FIGS. 4A-4D depict a detachable support plate that may be coupled a support harness. FIGS. 6A-6C schematically depict a coupling of one or more support harnesses to a subject, and FIG. 5 depicts various processes and/or steps in a method of placing the one or more harnesses and operating an overhead lift.

As will be evident from the present disclosure, the support harnesses described herein allow for medical personnel to raise, lower, and/or rotate a horizontally positioned subject (e.g., a horizontally laying subject) from a prone position to a supine position (e.g., a 180° rotation) and/or from a supine position to a prone position (e.g., a 180° rotation) with minimum effort relative to previous manual methods of rotating a subject (e.g., personnel pushing and/or pulling on a subject, personnel utilizing bedsheets to move subjects, and/or various other actions that generally require physically demanding actions from medical personnel) and/or previous sling bar-connected straps and sheets. Furthermore, the use of the support harnesses described herein allows for a raising process, a lowering process, and/or a rotation process to be completed with fewer personnel relative to other manual methods of rotating a subject. That is, use of support harnesses described herein can be completed with as few as one or two individuals manipulating the subject, whereas other manual methods generally require greater than three individuals, particularly in instances where subjects are large in size (e.g., bariatric subjects), are connected to a plurality of leads, tubing, lines, braces, and/or the like, have a physical deformity that hinders movement, and/or the like. The support harnesses described herein are connectable to equipment that is more readily available, more easily transported, and less expensive than other devices, systems, and methods that can be used to raise, lower, and/or rotate subjects, such as specialized rotating beds, complex pulley systems that require particular positioning and arrangement over a surface that the subject is laying on, complex pulley systems having drive components for rotating subjects, complex systems that must be bolted to or otherwise connected over a bed or other surface upon which the subject is laying, systems that utilize webbing that may be difficult to arrange with respect to a subject and/or is subject to damage, devices that grip a bedsheet and have a potential to lose such a grip while a rotation process is occurring, and/or the like. The support straps described herein provide features that allow for easier preparation of a subject for raising, lowering, and/or rotation, and do not require medical personnel to reconfigure strap loops in the middle of a turning process in order to complete a turn. Other advantages of the methods described herein will be apparent upon a reading of the present disclosure.

FIG. 1 depicts an illustrative scene of a plurality of individuals (e.g., a first individual $C_1$ and a second individual $C_2$) performing a method of lifting a subject S positioned horizontally in a supine position on a person support apparatus 110. As depicted in FIG. 1, the first individual $C_1$ is controlling an overhead lift 150 that includes a sling bar 160 supported by a lifting strap 152. The sling bar 160 coupled to one or more support harnesses 200 that are positioned underneath the subject S (e.g., positioned between the subject S and the person support apparatus 110). The second individual $C_2$ is facilitating additional movement of the subject S and is ensuring that leads, tubing, lines, braces, and/or the like are correctly positioned, as described in greater detail herein. In some embodiments, an additional individual may also be present, such as a respiratory therapist or the like that maintains a positioning of the head of the subject S and ensures appropriate positioning of tubing or the like. As a result of the processes described herein, raising, lowering, and/or rotation of the horizontally positioned subject S is completed to move the subject S and/or to flip the subject S 180° from supine to prone (or alternatively from prone to supine).

The person support apparatus 110 is generally a component for supporting the subject S thereon. For example, the person support apparatus 110 may be a hospital bed, a stretcher, a surgical table, a gurney, a chair, or similar support apparatuses commonly found in hospitals, nursing homes, rehabilitation centers, or the like. The person support apparatus 110 generally includes a base frame, a plurality of lift members coupled to the base frame, and a support surface 120 supported by the base frame. The base frame also includes a plurality of wheels or casters that are movable along a ground surface and can be locked in position to prevent or hinder further movement.

The overhead lift 150 is generally a lifting device that is positioned above the subject S and the person support apparatus 110 and is movable upwards or downwards (e.g., in the +z/−z direction of the coordinate axes of FIG. 1), as described in greater detail herein. The overhead lift 150 is depicted in FIG. 1 as a rail-mounted lift. However, the present disclosure is not limited to the rail-mounted lift depicted in FIG. 1. That is, other overhead lifts may be used to perform the methods described herein and included in the systems described herein. One illustrative example of another overhead lift 150 is a mobile lift that is generally a free-standing device that is movable along a floor surface of a hospital or medical facility. While only a single overhead lift 150 is depicted, it should be understood that a plurality of overhead lifts may be used, as described in greater detail herein. Illustrative examples of commercially available lifts include, but are not limited to, a Golvo® lift, a Viking® series lift, a Liko® lift, a LikoGuard™ overhead lift, a Likorall™ overhead lift, a Multirall™ overhead lift, and an UltraTwin™ overhead lift, all available from Hillrom (Batesville, Ind.).

As depicted in FIG. 1, the subject S may be supported by the lifting strap 152 via the sling bar 160, which is attached to the lifting strap 152. More specifically, the sling bar 160 may be attached to the one or more support harnesses 200 on which the subject S is positioned (as described in greater detail hereinbelow), thereby facilitating the lifting operation. The sling bar 160 has a length extending between a first end 162 of the sling bar 160 and a second end 166 of the sling bar 160. The first end 162 of the sling bar 160 includes a first retention component 164 and the second end 166 of the sling bar 160 includes a second retention component 168. The first retention component 164 and the second retention component 168 are generally shaped, sized, and configured to retain loops of the one or more support harnesses 200, as described in greater detail herein. For example, the first retention component 164 and the second retention component 168 may each be hook shaped, as depicted in FIG. 1. The length of the sling bar 160 is not limited by the present disclosure, and may generally be any length. In some embodiments, the length of the sling bar 160 may generally correspond to a width of the person support apparatus 110. In other embodiments, the length of the sling bar 160 may be sufficient to extend a distance that is the same or longer than a lateral width of the subject S supported by the sling bar 160 (e.g., a length taken along a transverse plane at a widest location on the subject S). In still other embodiments, the length of the sling bar 160 may be sufficient to extend a distance that is substantially the same as a distance between a subject's shoulders and a subject's thighs. That is, a distance between a subject's right shoulder and a midpoint of the subject's right thigh may substantially correspond to a length of the sling bar 160 in some embodiments. In embodiments, the sling bar 160 may be available in varying lengths to be used with subjects of varying heights (e.g., small, medium, large, extra-large sizes).

Figure 2B:
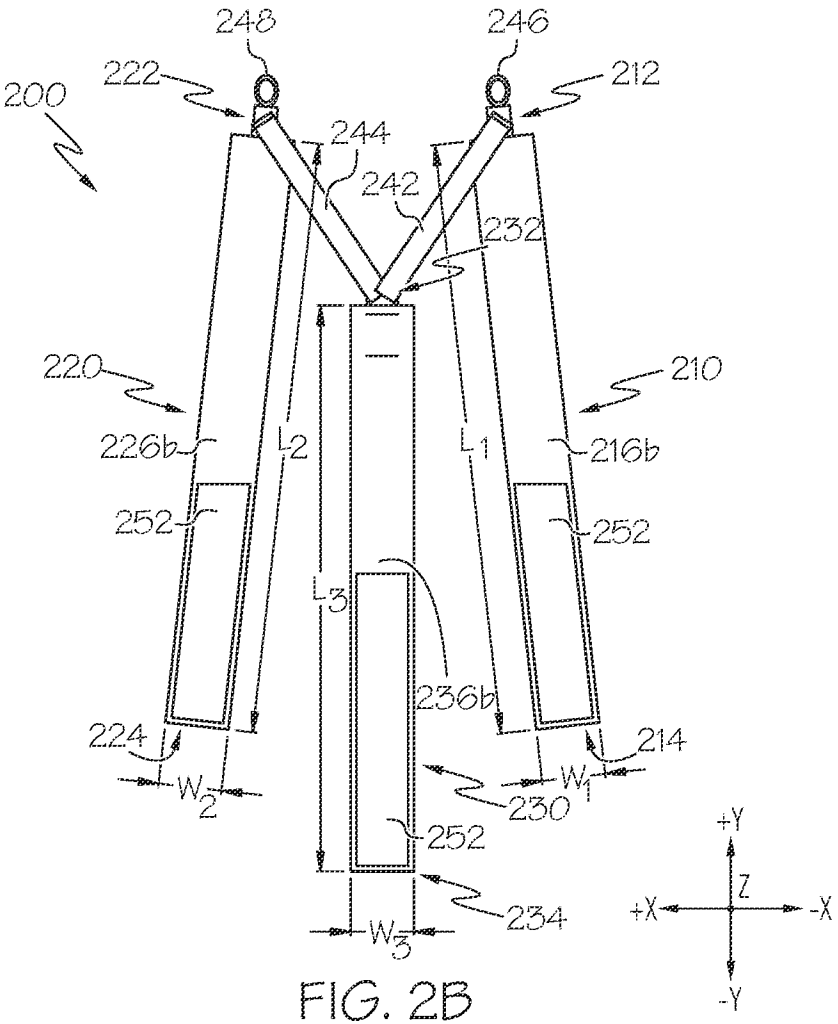
FIG. 2B depicts a rear view of the support harness of FIG. 2A according to one or more embodiments described herein.
Figure 2A:
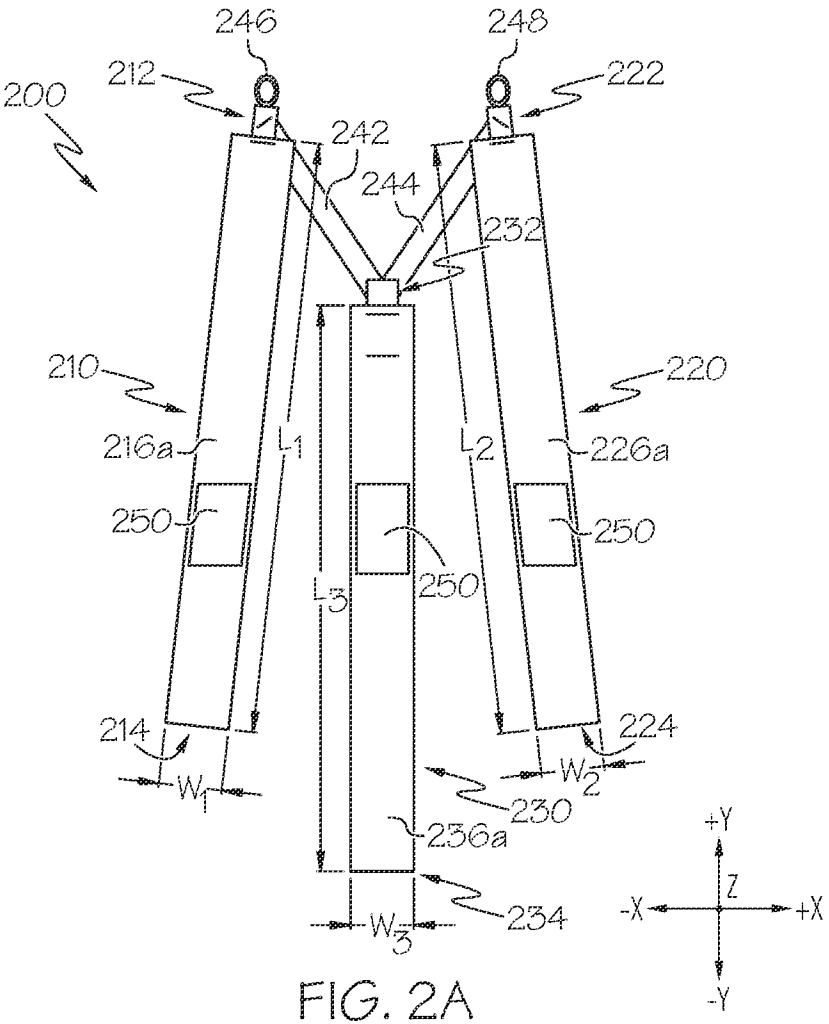
FIG. 2A depicts a front view of an illustrative support harness having a plurality of straps according to one or more embodiments shown and described herein.

FIGS. 2A-2D depict an illustrative support harness 200 according to one or more embodiments. As depicted in FIG. 2A, the support harness 200 generally includes a first strap 210, a second strap 220, and a third strap 230. The support harness 200 is arranged such that the first strap 210 and the second strap 220 are spaced apart from one another with the third strap 230 positioned between the first strap 210 and the second strap 220. The first strap 210 is coupled to the third strap 230 via a first connection piece 242 that extends between the first strap 210 and the third strap 230. The second strap 220 is coupled to the third strap 230 via a second connection piece 244 that extends between the second strap 220 and the third strap 230.

The first strap 210, the second strap 220, and the third strap 230 are generally arranged with respect to one another such that the straps 210, 220, 230 form an "M" like configuration, as depicted in FIGS. 2A-2B. That is, the third strap 230 extends in a generally system vertical direction (e.g., along the +y/−y axis of the coordinate axes of FIGS. 2A-2B) whereas the first strap 210 and the second strap 220 each extend at an angle relative to the system vertical direction (e.g., the +y/−y axis of the coordinate axes of FIGS. 2A-2B). For example, the first strap 210 may extend such that, when traversing a length of the first strap 210 in the −y direction of the coordinate axes of FIGS. 2A-2B, the first strap 210 extends towards the −x direction of the coordinate axes of FIGS. 2A-2B. In addition, the second strap 220 may extend such that, when traversing a length of the second strap 220 in the −y direction of the coordinate axes of FIGS. 2A-2B, the second strap 220 extends towards the +x direction of the coordinate axes of FIGS. 2A-2B. Such a configuration of the straps 210, 220, 230 generally results in the straps 210, 220, 230 being laterally spaced closer together toward the +y direction of the coordinate axes of FIGS. 2A-2B relative to the lateral spacing of the straps 210, 220, 230 toward the −y direction of the coordinate axes of FIGS. 2A-2B (where the straps 210, 220, 230 are spaced relatively farther apart). Such an arrangement of the straps 210, 220, 230 in this manner may allow for the straps to extend away from one another at one end thereof toward particular portions of a subject, while remaining more closely arranged at the other end thereof for coupling to a sling bar 160, as described in greater detail herein. In some embodiments, such an arrangement of the straps 210, 220, 230 may allow for the straps to be positioned on the subject S (FIG. 1) substantially parallel to one another. It should be understood that the arrangement of the straps 210, 220, 230 is merely illustrative, and other arrangements and configurations are contemplated.

The first strap 210 is generally a strip of material having a proximal end 212 and a distal end 214 spaced a length $L_1$ from the proximal end 212. The length $L_1$ of the first strap 210 is generally not limited by this disclosure, and may be any length that allows the first strap 210 to extend from a sling bar and wrap around a portion of a subject (e.g., an arm or a leg of a subject), as described in greater detail herein. For example, the length $L_1$ of the first strap 210 may be from about 60 centimeters (cm) to about 180 cm, including about 60 cm, about 70 cm, about 80 cm, about 90 cm, about 100 cm, about 110 cm, about 120 cm, about 130 cm, about 140 cm, about 150 cm, about 160 cm, about 170 cm, about 180 cm, or any value or range between any two of these values (including endpoints). In some embodiments, the length $L_1$ of the first strap 210 may be according to a particular type of support harness 200 (e.g., various lengths for small, medium, large, and extra-large subjects).

The general shape of the first strap 210 is not limited by the present disclosure, and may generally be any shape. For example, as depicted in the embodiment FIGS. 2A-2B, the first strap 210 is generally rectangular in shape, where the length $L_1$ of the first strap 210 is longer than a width $W_1$ of the first strap 210. In other embodiments, the first strap 210 has a generally rectangular shape with tapered ends. That is, the first strap 210 may be shaped such that sides of the first strap 210 taper to a point at the proximal end 212 and the distal end 214 thereof. In some embodiments, the first strap 210 may be shaped such that the length $L_1$ of the first strap 210 is generally a multiple greater than a width $W_1$ of the first strap 210. For example, the length $L_1$ of the first strap 210 may be about five times or more greater than the width $W_1$ of the first strap 210. In some embodiments, such a multiple may provide dimensions that aid in ease of placement of the first strap 210 underneath a subject. Certain other shapes that allow for ease of use in placing the first strap 210 underneath a subject are also contemplated and included within the scope of the present disclosure.

Referring to FIGS. 2A and 2B, the first strap 210 includes a first major surface 216*a* and a second major surface 216*b* opposite the first major surface 216*a*. In some embodiments, the major surfaces 216*a*, 216*b* of the first strap 210 may include connection features for coupling one portion of the first strap 210 to itself, as described herein. For example, the major surfaces 216*a*, 216*b* of the first strap 210 may include respective portions of a hook-and-loop fastener. That is, the first major surface 216*a* of the first strap 210 may have a first portion 250 of a hook-and-loop fastener (e.g., a hook portion or a loop portion) thereon and the second major surface 216*b* may have a second portion 252 (e.g., the other of the hook portion or the loop portion) thereon such that, when the first strap 210 is manipulated as described herein, the first major surface 216*a* and the second major surface 216*b* can be joined together and held in place by the portions 250, 252 of the hook-and-loop fastener.

In the embodiment depicted in FIG. 2A, only a portion of the first major surface 216*a* includes the first portion 250 of the hook-and-loop fastener. That is, the first portion 250 of the hook-and-loop fastener covers only a portion of the first major surface 216*a* at a location between the proximal end 212 and the distal end 214 of the first strap 210. In some embodiments, the first portion 250 of the hook-and-loop fastener may be located on the first major surface 216*a* such that a distance between the first portion 250 and the distal end 214 of the first strap 210 is greater than a circumference of a body part of the subject S (FIG. 1) such that the distal end 214 of first strap 210 can be wrapped around the body part without hindering access to the first portion 250 of the hook-and-loop fastener. For example, the first portion 250 of the hook-and-loop fastener may extend along the first major surface 216*a* at a distance that is at least about 30 cm from the distal end 214 of the first strap 210, including about 30 cm, about 40 cm, about 50 cm, about 60 cm, about 70 cm, about 80 cm, about 90 cm, about 100 cm, or greater than 100 cm. In some embodiments, the first portion 250 of the hook-and-loop fastener may be positioned approximately equidistant from the proximal end 212 and the distal end 214 of the first strap 210. In some embodiments, the first portion 250 of the hook-and-loop fastener may extend across the entire first major surface 216*a* of the first strap 210. That is, substantially all of the first major surface 216*a* may include the first portion 250 of the hook-and-loop fastener thereon.

In the embodiment depicted in FIG. 2B, only a portion of the second major surface 216*b* includes the second portion 252 of the hook-and-loop fastener. That is, the second portion 252 of the hook-and-loop fastener covers only a portion of the second major surface 216*b* at a location between the proximal end 212 and the distal end 214 of the first strap 210. In some embodiments, the second portion 252 of the hook-and-loop fastener may be located on the second major surface 216*b* at the distal end 214 of the first strap 210. In some embodiments, the second portion 252 of the hook-and-loop fastener may extend across the entire second major surface 216*b* of the first strap 210. That is, substantially all of the second major surface 216*b* may include the second portion 252 of the hook-and-loop fastener thereon.

Referring again to FIGS. 2A and 2B, the second strap 220 is generally a strip of material having a proximal end 222 and a distal end 224 spaced a length $L_2$ from the proximal end 222. The length $L_2$ of the second strap 220 is generally not limited by this disclosure, and may be any length that allows the second strap 220 to extend from a sling bar and wrap around a portion of a subject (e.g., an arm or a leg of a subject), as described in greater detail herein. For example, the length $L_2$ of the second strap 220 may be from about 60 centimeters (cm) to about 180 cm, including about 60 cm, about 70 cm, about 80 cm, about 90 cm, about 100 cm, about 110 cm, about 120 cm, about 130 cm, about 140 cm, about 150 cm, about 160 cm, about 170 cm, about 180 cm, or any value or range between any two of these values (including endpoints). In some embodiments, the length $L_2$ of the second strap 220 may be substantially similar to the length $L_1$ of the first strap 210. In some embodiments, the length $L_2$ of the second strap 220 may be according to a particular type of support harness 200 (e.g., various lengths for small, medium, large, and extra-large subjects).

The general shape of the second strap 220 is not limited by the present disclosure, and may generally be any shape. For example, as depicted in the embodiment FIGS. 2A-2B, the second strap 220 is generally rectangular in shape, where the length $L_2$ of the second strap 220 is longer than a width $W_2$ of the second strap 220. In other embodiments, the second strap 220 has a generally rectangular shape with tapered ends. That is, the second strap 220 may be shaped such that sides of the second strap 220 taper to a point at the proximal end 222 and the distal end 224 thereof. In some embodiments, the second strap 220 may be shaped such that the length $L_2$ of the second strap 220 is generally a multiple greater than a width $W_2$ of the second strap 220. For example, the length $L_2$ of the second strap 220 may be about five times or more greater than the width $W_2$ of the second strap 220. In some embodiments, such a multiple may provide dimensions that aid in ease of placement of the second strap 220 underneath a subject. Certain other shapes that allow for ease of use in placing the second strap 220 underneath a subject are also contemplated and included within the scope of the present disclosure.

The second strap 220 includes a first major surface 226*a* and a second major surface 226*b* opposite the first major surface 226*a*. In some embodiments, the major surfaces 226*a*, 226*b* of the second strap 220 may include connection features for coupling one portion of the second strap 220 to itself, as described herein. For example, the major surfaces 226*a*, 226*b* of the second strap 220 may include respective portions of a hook-and-loop fastener. That is, the first major surface 226*a* of the second strap 220 may have a first portion 250 of a hook-and-loop fastener (e.g., a hook portion or a loop portion) thereon and the second major surface 226*b* may have a second portion 252 (e.g., the other of the hook portion or the loop portion) thereon such that, when the second strap 220 is manipulated as described herein, the first major surface 226*a* and the second major surface 226*b* can be joined together and held in place by the portions 250, 252 of the hook-and-loop fastener.

In the embodiment depicted in FIG. 2A, only a portion of the first major surface 226*a* includes the first portion 250 of the hook-and-loop fastener. That is, the first portion 250 of the hook-and-loop fastener covers only a portion of the first major surface 226*a* at a location between the proximal end 222 and the distal end 224 of the second strap 220. In some embodiments, the first portion 250 of the hook-and-loop fastener may be located on the first major surface 226*a* such that a distance between the first portion 250 and the distal end 224 of the second strap 220 is greater than a circumference of a body part of the subject S (FIG. 1) such that the distal end 224 of second strap 220 can be wrapped around the body part without hindering access to the first portion 250 of the hook-and-loop fastener. For example, the first portion 250 of the hook-and-loop fastener may extend along the first major surface 226*a* at a distance that is at least about 30 cm from the distal end 224 of the second strap 220, including about 30 cm, about 40 cm, about 50 cm, about 60 cm, about 70 cm, about 80 cm, about 90 cm, about 100 cm, or greater than 100 cm. In some embodiments, the first portion 250 of the hook-and-loop fastener may be positioned approximately equidistant from the proximal end 222 and the distal end 224 of the second strap 220. In some embodiments, the first portion 250 of the hook-and-loop fastener may extend across the entire first major surface 226*a* of the second strap 220. That is, substantially all of the first major surface 226*a* may include the first portion 250 of the hook-and-loop fastener thereon.

In the embodiment depicted in FIG. 2B, only a portion of the second major surface 226*b* includes the second portion 252 of the hook-and-loop fastener. That is, the second portion 252 of the hook-and-loop fastener covers only a portion of the second major surface 226*b* at a location between the proximal end 222 and the distal end 224 of the second strap 220. In some embodiments, the second portion 252 of the hook-and-loop fastener may be located on the second major surface 226*b* at the distal end 224 of the second strap 220. In some embodiments, the second portion 252 of the hook-and-loop fastener may extend across the entire second major surface 226*b* of the second strap 220. That is, substantially all of the second major surface 226*b* may include the second portion 252 of the hook-and-loop fastener thereon.

Referring again to FIGS. 2A and 2B, the third strap 230 is generally a strip of material having a proximal end 232 and a distal end 234 spaced a length $L_3$ from the proximal end 232. The length $L_3$ of the third strap 230 is generally not limited by this disclosure, and may be any length that allows the third strap 230 to extend from a sling bar and wrap around a portion of a subject (e.g., a torso of a subject), as described in greater detail herein. For example, the length $L_3$ of the third strap 230 may be from about 60 centimeters (cm) to about 300 cm, including about 60 cm, about 70 cm, about 80 cm, about 90 cm, about 100 cm, about 110 cm, about 120 cm, about 130 cm, about 140 cm, about 150 cm, about 160 cm, about 170 cm, about 180 cm, about 190 cm, about 200 cm, about 210 cm, about 220 cm, about 230 cm, about 240 cm, about 250 cm, about 260 cm, about 270 cm, about 280 cm, about 290 cm, about 300 cm or any value or range between any two of these values (including endpoints). In some embodiments, the length $L_3$ of the third strap 230 may be longer than the length $L_1$ of the first strap 210 and/or the length $L_2$ of the second strap 220. In some embodiments, the length $L_3$ of the third strap 330 may be according to a particular type of support harness 200 (e.g., various lengths for small, medium, large, and extra-large subjects).

The general shape of the third strap 230 is not limited by the present disclosure, and may generally be any shape. For example, as depicted in the embodiment FIGS. 2A-2B, the third strap 230 is generally rectangular in shape, where the length $L_3$ of the third strap 230 is longer than a width $W_3$ of the third strap 230. In other embodiments, the third strap 230 has a generally rectangular shape with tapered ends. That is, the third strap 230 may be shaped such that sides of the third strap 230 taper to a point at the proximal end 232 and the distal end 234 thereof. In some embodiments, the third strap 230 may be shaped such that the length $L_3$ of the third strap 230 is generally a multiple greater than a width $W_3$ of the third strap 230. For example, the length $L_3$ of the third strap 230 may be about five times or more greater than the width $W_3$ of the third strap 230. In some embodiments, such a multiple may provide dimensions that aid in ease of placement of the third strap 230 underneath a subject. Certain other shapes that allow for ease of use in placing the third strap 230 underneath a subject are also contemplated and included within the scope of the present disclosure.

The third strap 230 includes a first major surface 236*a* and a second major surface 236*b* opposite the first major surface 236*a*. In some embodiments, the major surfaces 236*a*, 236*b* of the third strap 230 may include connection features for coupling one portion of the third strap 230 to itself, as described herein. For example, the major surfaces 236*a*, 236*b* of the third strap 230 may include respective portions of a hook-and-loop fastener. That is, the first major surface 236*a* of the third strap 230 may have a first portion 250 of a hook-and-loop fastener (e.g., a hook portion or a loop portion) thereon and the second major surface 236*b* may have a second portion 252 (e.g., the other of the hook portion or the loop portion) thereon such that, when the third strap 230 is manipulated as described herein, the first major surface 236*a* and the second major surface 236*b* can be joined together and held in place by the portions 250, 252 of the hook-and-loop fastener.

In the embodiment depicted in FIG. 2A, only a portion of the first major surface 236*a* includes the first portion 250 of the hook-and-loop fastener. That is, the first portion 250 of the hook-and-loop fastener covers only a portion of the first major surface 236*a* at a location between the proximal end 232 and the distal end 234 of the third strap 230. In some embodiments, the first portion 250 of the hook-and-loop fastener may be located on the first major surface 236*a* such that a distance between the first portion 250 and the distal end 234 of the third strap 230 is greater than a circumference of a body part of the subject S (FIG. 1) such that the distal end 234 of third strap 230 can be wrapped around the body part without hindering access to the first portion 250 of the hook-and-loop fastener. For example, the first portion 250 of the hook-and-loop fastener may extend along the first major surface 236*a* at a distance that is at least about 30 cm from the distal end 234 of the third strap 230, including about 30 cm, about 40 cm, about 50 cm, about 60 cm, about 70 cm, about 80 cm, about 90 cm, about 100 cm, or greater than 100 cm. In some embodiments, the first portion 250 of the hook-and-loop fastener may be positioned approximately equidistant from the proximal end 232 and the distal end 234 of the third strap 230. In some embodiments, the first portion 250 of the hook-and-loop fastener may extend across the entire first major surface 236*a* of the third strap 230. That is, substantially all of the first major surface 236*a* may include the first portion 250 of the hook-and-loop fastener thereon.

In the embodiment depicted in FIG. 2B, only a portion of the second major surface 236*b* includes the second portion 252 of the hook-and-loop fastener. That is, the second portion 252 of the hook-and-loop fastener covers only a portion of the second major surface 236*b* at a location between the proximal end 232 and the distal end 234 of the third strap 230. In some embodiments, the second portion 252 of the hook-and-loop fastener may be located on the second major surface 236*b* at the distal end 234 of the third strap 230. In some embodiments, the second portion 252 of the hook-and-loop fastener may extend across the entire second major surface 236*b* of the third strap 230. That is, substantially all of the second major surface 236*b* may include the second portion 252 of the hook-and-loop fastener thereon.

Figure 2C:
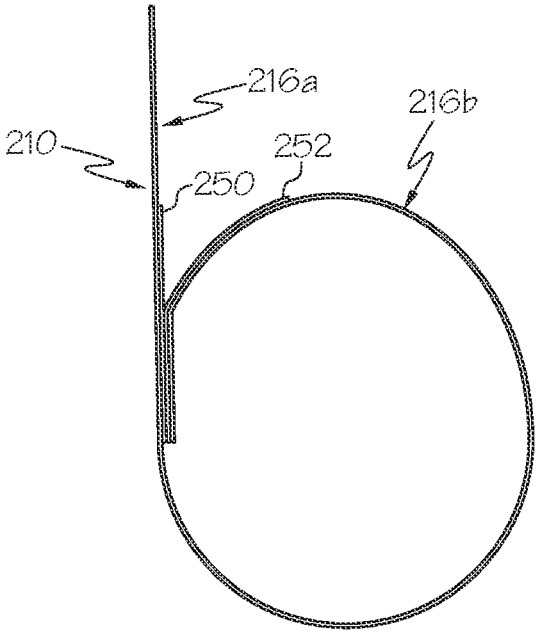
FIG. 2C depicts a side view of an illustrative strap of the support harness of FIG. 2A when arranged in a connected position according to one or more embodiments shown and described herein.
Figure 2D:
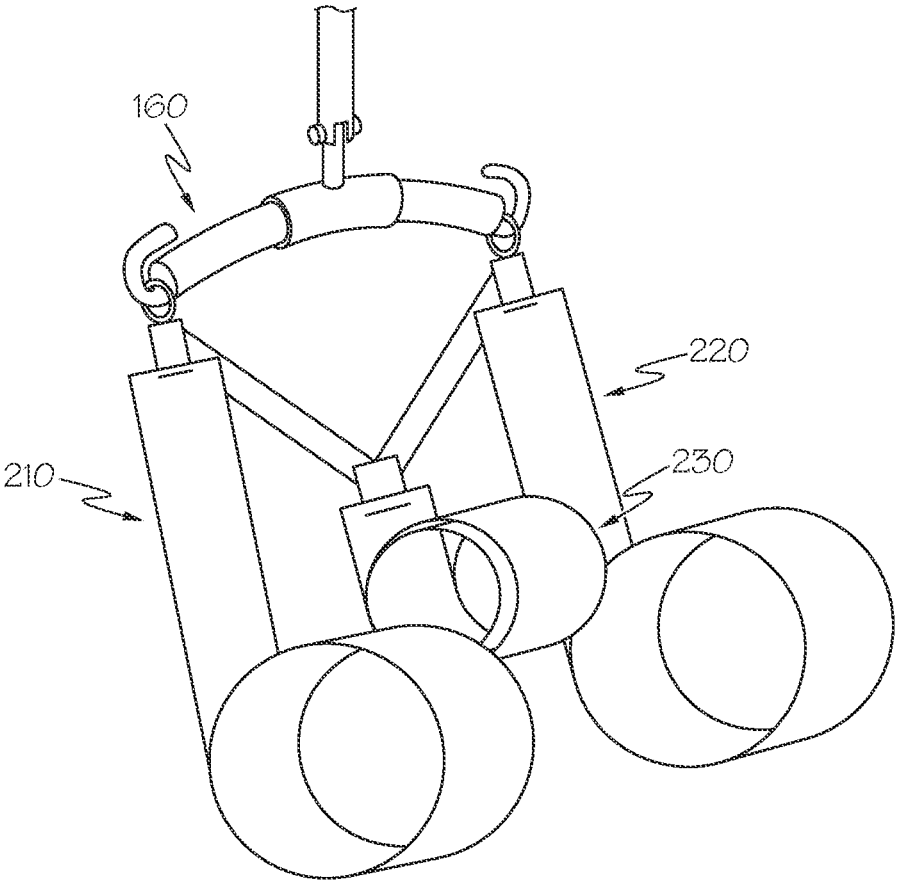
FIG. 2D depicts a side perspective view of the support harness of FIG. 2A with a plurality of illustrative straps arranged in a connected position according to one or more embodiments shown and described herein.

Referring to FIGS. 2C and 2D, each of the first strap 210, the second strap 220, and the third strap 230 may be constructed of a type of material that allows the straps 210, 220, 230 to be flexible such that the straps 210, 220, 230 can be manipulated (e.g., rolled up, folded, twisted, and/or the like). For example, as shown in FIG. 2C, the flexible material of the first strap 210 may allow the first strap 210 to be manipulated such that the second major surface 216*b* can contact the first major surface 216*a*, thereby allowing the first portion 250 of the hook-and-loop fastener to contact the second portion 252 of the hook-and-loop fastener and couple the first major surface 216*a* to the second major surface 216*b*, thereby forming a loop that can hold a portion of a subject (e.g., an arm or a leg of a subject), as described in greater detail herein. While FIG. 2C only depicts the first strap 210 as being manipulated to form a loop configuration, it should be understood that the second strap 220 and the third strap 230 may also be manipulated in a similar manner, as shown in FIG. 2D. Still referring to FIG. 2D, in some embodiments, the straps 210, 220, 230 may be formed from a textile comprising natural fibers that are derived from animal (protein), vegetable (cellulose), and/or mineral sources. Illustrative examples of natural fibers include, but are not limited to, cellulose (staple) fibers such as bast, leaf, seed hair, cane, grass, and reed; protein (staple) fibers such as hair, wool, and/or filaments (e.g., secretions such as silk); and mineral fibers such as asbestos, glass, gold, silver, and/or the like. In some embodiments, the straps 210, 220, 230 may be formed from one or more manufactured fibers such as manmade (human made), regenerated, or synthetic fibers having a chemical composition that is organic or inorganic or derivatives thereof. In some embodiments the straps 210, 220, 230 may be formed from one or more fibers having a chemical composition that is organic or inorganic. Illustrative examples of organic polymer fibers from natural sources include, but are not limited to, acetate, alginate, cupro, elastodiene, lyocell, model, triacetate, and viscose. Illustrative examples of organic fibers made from synthetic polymers include, but are not limited to, acrylic, aramid, chlorofibre, elastane, elastodiene, elastoelfin, elastomultiester, flurofiber, melamine, modacrylic, polyamide, polyester, polyethelene, polyimide, polylactic acid, polypropylene, polypropylene/polyamide biocomponent, and vinylal. Illustrative examples of inorganic fibers include, but are not limited to, carbon, ceramic, glass, and metal.

Referring again to FIGS. 2A and 2B, the first connection piece 242 and the second connection piece 244 of the support harness 200 are arranged such that the first connection piece 242 extends between and connects the first strap 210 to the third strap 230 and the second connection piece 244 extends between and connects the second strap 220 to the third strap 230. More specifically, the first connection piece 242 may be coupled to a portion of the first strap 210 at the proximal end 212 thereof (or to an extension component extending from the proximal end 212 of the first strap 210) and may be coupled to a portion of the third strap 230 at the proximal end 232 thereof (or to an extension component extending from the proximal end 232 of the third strap 230). In addition, the second connection piece 244 may be coupled to a portion of the second strap 220 at the proximal end 222 thereof (or to an extension component extending from the proximal end 222 of the second strap 220) and may be coupled to a portion of the third strap 230 at the proximal end 232 thereof (or to an extension component extending from the proximal end 232 of the third strap 230). In some embodiments, the first connection piece 242 may be coupled to the first strap 210 and the third strap 230 via stitching, bonding, welding (e.g., radio frequency welding), attachment via adhesive, and/or the like. In other embodiments, the first connection piece 242 may be integrated as part of the first strap 210 and/or the third strap 230. That is, the first connection piece 242 may a component of the first strap 210 and/or the third strap 230 that extends from the first strap 210 and/or the third strap 230 such that the first strap, 210, the first connection piece 242, and the third strap 230 are all formed as a single component. In some embodiments, the second connection piece 244 may be coupled to the second strap 220 and the third strap 230 via stitching, bonding, welding (e.g., radio frequency welding), attachment via adhesive, and/or the like. In other embodiments, the second connection piece 244 may be integrated as part of the second strap 220 and/or the third strap 230. That is, the second connection piece 244 may a component of the second strap 220 and/or the third strap 230 that extends from the second strap 220 and/or the third strap 230 such that the second strap, 220, the second connection piece 244, and the third strap 230 are all formed as a single component. In some embodiments, the first strap 210, the first connection piece 242, the third strap 230, the second connection piece 244, and the second strap 220 may all be formed as a one piece assembly.

Still referring to FIGS. 2A and 2B, in various embodiments, the support harness 200 generally includes at least one first loop 246 extending from the proximal end 212 of the first strap 210 and at least one second loop 248 extending from the proximal end 222 of the second strap 220. The loops 246, 248 each provide a connection point for the support harness 200 to be connected to another object. For example, in the embodiments described herein, the loops 246, 248 are used as a connection point for connecting the support harness 200 to the sling bar 160 (FIG. 1). The first loop 246 is coupled to the proximal end 212 of the first strap 210 (or to an extension component extending from the proximal end 212 of the first strap 210) by any means of coupling, including, but not limited to, stitching, welding, use of fasteners (e.g., rivets or the like), use of adhesives, and/or the like. In addition, the second loop 248 is coupled to the proximal end 222 of the second strap 220 (or to an extension component extending from the proximal end 222 of the second strap 220) by any means of coupling, including, but not limited to, stitching, welding, use of fasteners (e.g., rivets or the like), use of adhesives, and/or the like. In some embodiments, the loops 246, 248 are integrated with the first strap 210 and the second strap 220, respectively. That is, the loops 246, 248 are formed as an extension of the material of the first strap 210 and the second strap 220, respectively, such that the first strap 210 and the second strap 220 (including the loops 246, 248) are all formed from a single piece of material. In some embodiments, the loops 246, 248 may be formed as an extension of a piping material that surrounds the various edges of the first strap 210 and the second strap 220.

The loops 246, 248 may generally be constructed of any type of material, and such materials are not limited by the present disclosure. In some embodiments, the loops may be constructed of a material that has load bearing properties that allow the support harness 200, together with the loops 246, 248, to support the weight of a human subject. In some embodiments, the loops may be formed from a textile comprising natural fibers that are derived from animal (protein), vegetable (cellulose), and/or mineral sources. Illustrative examples of natural fibers include, but are not limited to, cellulose (staple) fibers such as bast, leaf, seed hair, cane, grass, and reed; protein (staple) fibers such as hair, wool, and/or filaments (e.g., secretions such as silk); and mineral fibers such as asbestos, glass, gold, silver, and/or the like. In some embodiments, the straps 210, 220, 230 may be formed from one or more manufactured fibers such as manmade (human made), regenerated, or synthetic fibers having a chemical composition that is organic or inorganic or derivatives thereof. In some embodiments the straps 210, 220, 230 may be formed from one or more fibers having a chemical composition that is organic or inorganic. Illustrative examples of organic polymer fibers from natural sources include, but are not limited to, acetate, alginate, cupro, elastodiene, lyocell, model, triacetate, and viscose. Illustrative examples of organic fibers made from synthetic polymers include, but are not limited to, acrylic, aramid, chlorofibre, elastane, elastodiene, elastoelfin, elastomultiester, flurofiber, melamine, modacrylic, polyamide, polyester, polyethelene, polyimide, polylactic acid, polypropylene, polypropylene/polyamide biocomponent, and vinylal. Illustrative examples of inorganic fibers include, but are not limited to, carbon, ceramic, glass, and metal. In still other embodiments, the loops 246, 248 may be metal or plastic loops, such as, for example, metallic or plastic torus shaped rings.

Still referring to FIGS. 2A and 2B, in some embodiments, the support harness 200 may be constructed such that the first major surfaces 216*a*, 226*a*, 236*a* of the first strap 210, the second strap 220, and the third strap 230, respectively, are each constructed of or coated with a high-friction material and the second major surfaces 216*b*, 226*b*, 236*b*, of the first strap 210, the second strap 220, and the third strap 230, respectively, are constructed of or coated with a low-friction material. The low-friction material is generally any material having a coefficient of friction that is lower than a coefficient of friction of the high-friction material. In some embodiments, the low-friction material may be any material that has a coefficient of friction that is lower than a coefficient of friction of an uncoated or untreated surface of the support harness 200. In some embodiments, the high-friction material may be any material that has a coefficient of friction that is the same or higher than a coefficient of friction of an uncoated or untreated surface of the support harness. The coefficient of friction is a quantitative measure of the friction between two surfaces, including the first major surfaces 216*a*, 226*a*, 236*a* and the second major surfaces 216*b*, 226*b*, 236*b*, including surface roughness, and environmental conditions such as, but not limited to, temperature and humidity. In some embodiments, the coefficient of friction refers to a maximum coefficient of friction measured at a normal load of 30 N as measured in a standard test equipment, such as, for example, a vial overlay test jig. In one example, a low coefficient of friction may be about 0.9 or less relative to an uncoated surface, including, about 0.9, about 0.8, about 0.7, about 0.6, about 0.5, about 0.4, about 0.3, about 0.2, about 0.1 or less relative to an uncoated surface, or any range or value between any two of these values. In another example, a high coefficient of friction may be about 1.0 or greater relative to an uncoated surface, including about 1.0, about 1.5, about 2.0, about 2.5, about 3.0, about 3.5, about 4.0 or greater relative to an uncoated surface, or any range or value between any two of these values. In some embodiments, the first major surfaces 216*a*, 226*a*, 236*a* having the low-friction material may be constructed such that a low-friction coating on the second major surfaces 216*b*, 226*b*, 236*b* is directional. That is, for example, the second major surfaces 216*b*, 226*b*, 236*b* may each exhibit a lower coefficient of friction along the respective lengths $L_1$, $L_2$, $L_3$ of the straps 210, 220, 230 relative to a coefficient of friction along the respective widths $W_1$, $W_2$, $W_3$ of the straps 210, 220, 230.

In some embodiments, the support harness 200 may be arranged relative to the subject such that the first major surfaces 216*a*, 226*a*, 236*a* having the high-friction material faces the subject and the second major surfaces 216*b*, 226*b*, 236*b* having the low-friction material face the surface upon which the subject is laying. Such an arrangement may allow the support harness 200 to be more easily slid underneath the subject (e.g., such that the low-friction surfaces slide more easily along the support surface) relative to a surface not having the low friction material thereon or integrated therewith. Further, the high-friction material may retain a grip on the subject to avoid slippage, particularly when the subject is lifted.

Still referring to FIGS. 2A and 2B, in some embodiments, the support harness 200 may have indicia thereon. The location and type of indicia is not limited by the present disclosure, and may generally be any location and type. In some embodiments, the indicia may provide an indication of an arrangement of various straps of the support harness 200 with respect to a subject. That is, the indicia may provide one or more indicators to a user about how to position the subject with respect to the first strap 210, the second strap 220, and/or the third strap 230. Illustrative examples of indicia include, but are not limited to, lines, shapes, images, text, anatomical drawings, measurement marks (e.g., a ruler), or the like. In some embodiments, the indicia may be color coded or otherwise visually distinguishable for the purposes of indicating a particular arrangement, positioning, and/or the like of the first strap 210, the second strap 220, and/or the third strap 230.

It should be understood that the components of the support harness 200 are merely illustrative, and other components, including additional components and alternative components that provide support to a subject as described herein are contemplated and included within the scope of the present disclosure. For example, the connection features (e.g., the hook-and-loop fasteners) are one illustrative example of connection features that are contemplated. FIGS. 3A-3E relate to another type of connection feature that may be used.

Figure 3B:
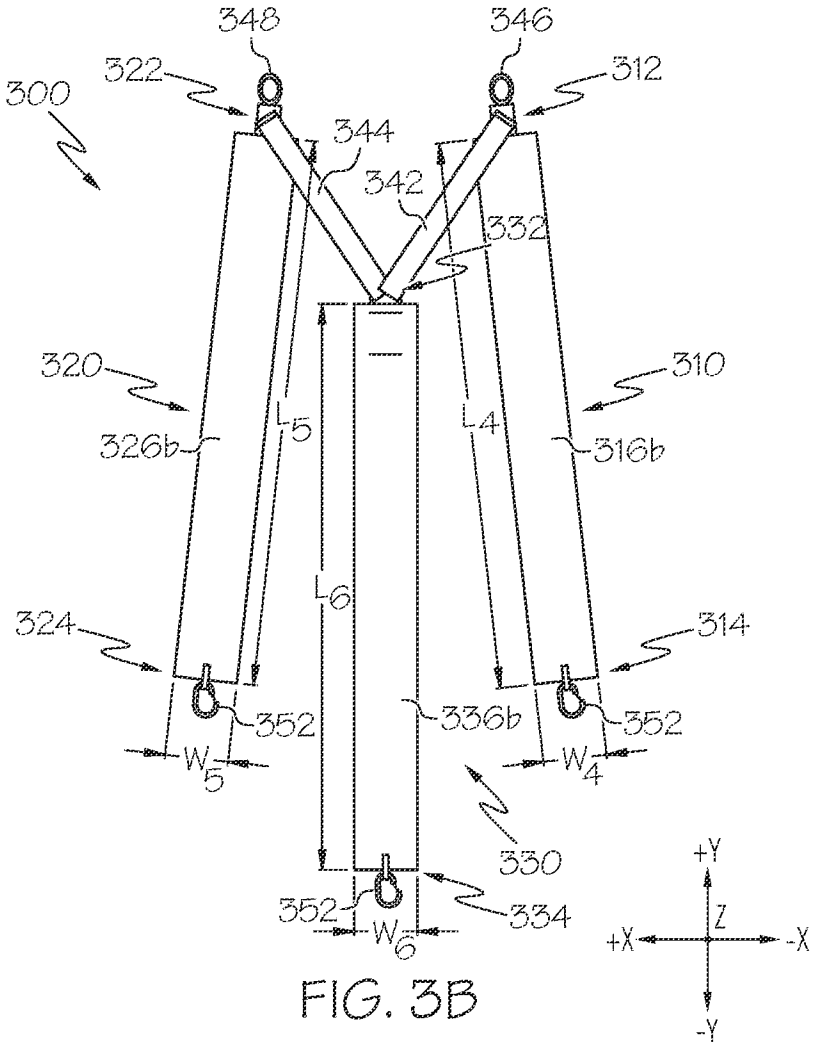
FIG. 3B depicts a rear view of the support harness of FIG. 3A according to one or more embodiments shown and described herein.
Figure 3A:
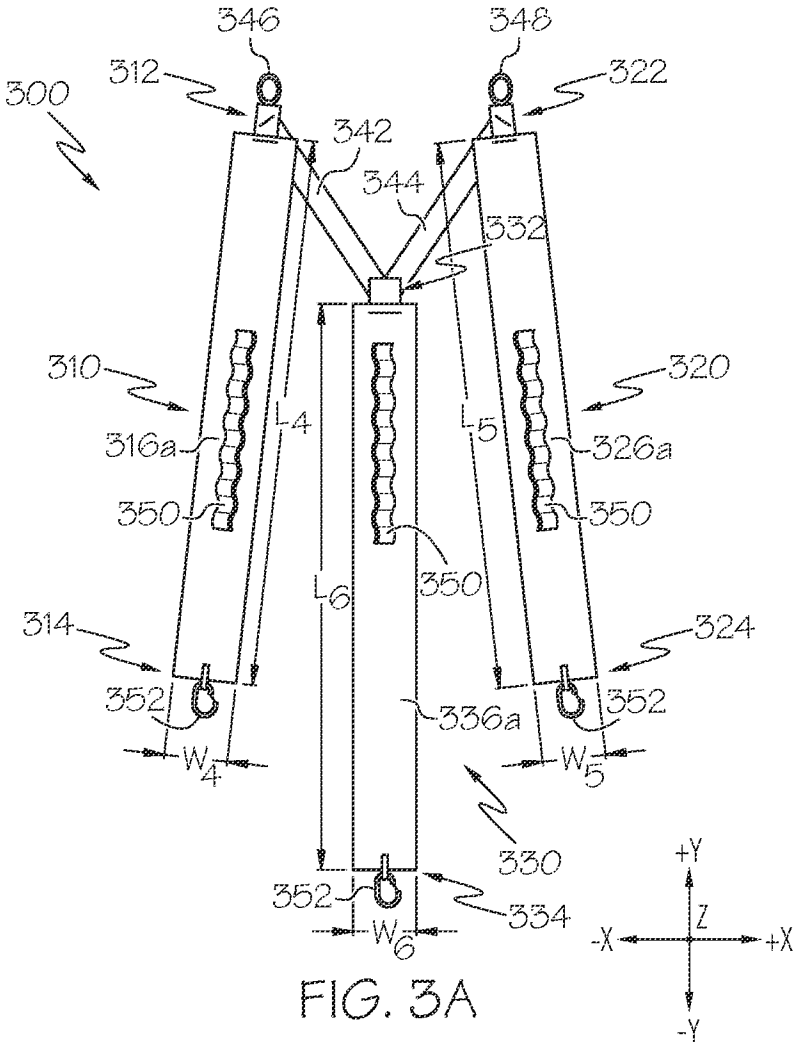
FIG. 3A depicts a front view of another illustrative support harness having a plurality of straps according to one or more embodiments shown and described herein.
Figure 3C:
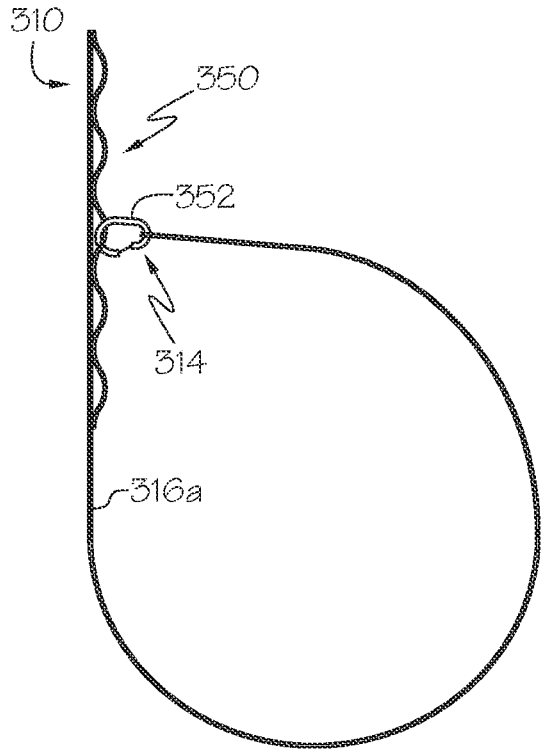
FIG. 3C depicts a side view of an illustrative strap of the support harness of FIG. 3A when arranged in a connected position according to one or more embodiments shown and described herein.
Figure 3D:
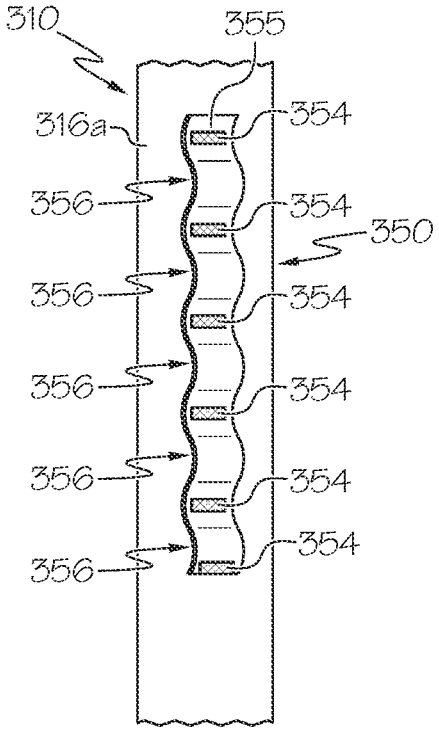
FIG. 3D depicts a detailed view of an illustrative plurality of connection points of the support harness of FIG. 3A according to one or more embodiments shown and described herein.

FIGS. 3A-3E depict another illustrative support harness 300 according to one or more embodiments. As depicted in FIG. 3A, the support harness 300 generally includes a first strap 310, a second strap 320, and a third strap 330, each of the first strap 310, the second strap 320 and the third strap 330 including a plurality of connection points 350 and a connector 352. The support harness 300 is arranged such that the first strap 310 and the second strap 320 are spaced apart from one another with the third strap 330 positioned between the first strap 310 and the second strap 320. The first strap 310 is coupled to the third strap 330 via a first connection piece 342 that extends between the first strap 310 and the third strap 330. The second strap 320 is coupled to the third strap 330 via a second connection piece 344 that extends between the second strap 320 and the third strap 330.

The first strap 310, the second strap 320, and the third strap 330 are generally arranged with respect to one another such that the straps 310, 320, 330 form an "M" like configuration, as depicted in FIGS. 3A-3B. That is, the third strap 330 extends in a generally system vertical direction (e.g., along the +y/−y axis of the coordinate axes of FIGS. 3A-3B) whereas the first strap 310 and the second strap 320 each extend at an angle relative to the system vertical direction (e.g., the +y/−y axis of the coordinate axes of FIGS. 3A-3B). For example, the first strap 310 may extend such that, when traversing a length of the first strap 310 in the −y direction of the coordinate axes of FIGS. 3A-3B, the first strap 310 extends towards the −x direction of the coordinate axes of FIGS. 3A-3B. In addition, the second strap 320 may extend such that, when traversing a length of the second strap 320 in the −y direction of the coordinate axes of FIGS. 3A-3B, the second strap 320 extends towards the +x direction of the coordinate axes of FIGS. 3A-3B. Such a configuration of the straps 310, 320, 330 generally results in the straps 310, 320, 330 being laterally spaced closer together toward the +y direction of the coordinate axes of FIGS. 3A-3B relative to the lateral spacing of the straps 310, 320, 330 toward the −y direction of the coordinate axes of FIGS. 3A-3B (where the straps 310, 320, 330 are spaced relatively farther apart). Such an arrangement of the straps 310, 320, 330 in this manner may allow for the straps to extend away from one another at one end thereof toward particular portions of a subject, while remaining more closely arranged at the other end thereof for coupling to a sling bar, as described in greater detail herein. It should be understood that the arrangement of the straps 310, 320, 330 is merely illustrative, and other arrangements and configurations are contemplated.

The first strap 310 is generally a strip of material having a proximal end 312 and a distal end 314 spaced a length $L_4$ from the proximal end 312. The length $L_4$ of the first strap 310 is generally not limited by this disclosure, and may be any length that allows the first strap 310 to extend from a sling bar and wrap around a portion of a subject, as described in greater detail herein. For example, the length $L_4$ of the first strap 310 may be from about 60 centimeters (cm) to about 180 cm, including about 60 cm, about 70 cm, about 80 cm, about 90 cm, about 100 cm, about 110 cm, about 120 cm, about 130 cm, about 140 cm, about 150 cm, about 160 cm, about 170 cm, about 180 cm, or any value or range between any two of these values (including endpoints). In some embodiments, the length $L_4$ of the first strap 310 may be according to a particular type of support harness 300 (e.g., various lengths for small, medium, large, and extra-large subjects).

The general shape of the first strap 310 is not limited by the present disclosure, and may generally be any shape. For example, as depicted in the embodiment FIGS. 3A-3B, the first strap 310 is generally rectangular in shape, where the length $L_4$ of the first strap 310 is longer than a width $W_4$ of the first strap 310. In other embodiments, the first strap 310 has a generally rectangular shape with tapered ends. That is, the first strap 310 may be shaped such that sides of the first strap 310 taper to a point at the proximal end 312 and the distal end 314 thereof. In some embodiments, the first strap 310 may be shaped such that the length $L_4$ of the first strap 310 is generally a multiple greater than a width $W_4$ of the first strap 310. For example, the length $L_4$ of the first strap 310 may be about five times or more greater than the width $W_4$ of the first strap 310. In some embodiments, such a multiple may provide dimensions that aid in ease of placement of the first strap 310 underneath a subject. Certain other shapes that allow for ease of use in placing the first strap 310 underneath a subject are also contemplated and included within the scope of the present disclosure.

Still referring to FIGS. 3A and 3B, the first strap 310 includes a first major surface 316*a* and a second major surface 316*b* opposite the first major surface 316*a*. The first major surface 316*a* includes the plurality of connection points 350 thereon. The plurality of connection points 350 each generally provide a location for coupling the connector 352 to the first major surface 316*a* of the first strap 310, as depicted for example in FIG. 3C. The plurality of connection points are not limited by the present disclosure and may be any type of connection point. FIG. 3D depicts one embodiment of the connection points 350 whereby a strip of material 355 is attached to the first strap 310 at a plurality of points 354 while remaining separated from the first strap 310 between the points 354, creating a plurality of banded loops 356, each banded loop 356 being located between two of the points 354. The strip of material 355 may generally be attached to the first strap 310 via stitching, bonding, welding (e.g., radio frequency welding), attachment via adhesive, and/or the like. The size of each banded loop 356 is generally not limited by the present disclosure, and may be any size that allows for connection with the connector 352 (FIGS. 3A-3C), as described in greater detail herein. While FIG. 3D depicts five banded loops 356, any number of banded loops 356 is contemplated, including, but not limited to, one banded loop, two banded loops, three banded loops, four banded loops, five banded loops, six banded loops, seven banded loops, eight banded loops, or greater than eight banded loops. In addition, while FIG. 3D depicts the banded loops 356 as being generally the same size (e.g., such that the points 354 are equidistant from one another), the present disclosure is not limited to such. That is, the points 354 may be at various distances relative to one another to make a plurality of different sized banded loops 356.

Figure 3E:
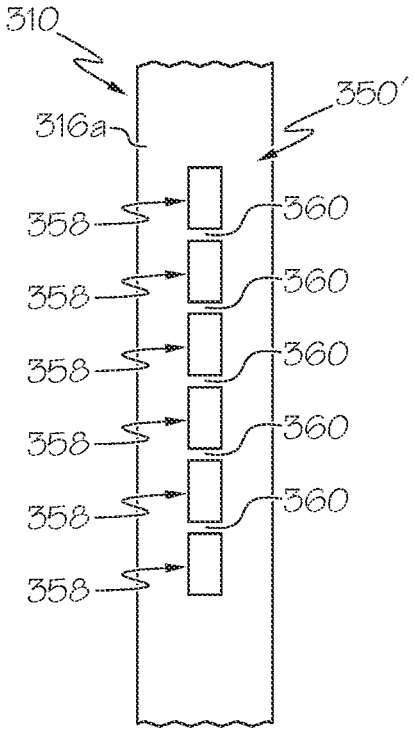
FIG. 3E depicts a detailed view of another illustrative plurality of connection points of the support harness of FIG. 3A according to one or more embodiments shown and described herein.

FIG. 3E depicts another embodiment of the connection points 350' whereby the first strap 310 includes a plurality of through-holes 358 (e.g., grommets) through the material thereof. The through-holes 358 are separated from each other by a strip of material 360 of the first strap 310. As such, two adjacent through-holes 358 can provide a connection point at the strip of material 360 therebetween. In some embodiments, the material surrounding each of the through-holes 358 may be reinforced to prevent weakening from repeated forces acting on the material. While FIG. 3E depicts six through-holes 358, the present disclosure is not limited to such and any number of through-holes 358 greater than or equal to two is contemplated, including two through-holes, three through-holes, four through-holes, five through-holes, six through-holes, seven through-holes, eight through-holes, or greater than eight through-holes. In addition, while FIG. 3E depicts the through-holes 358 as being generally the same shape and size and being spaced equidistantly from one another, the present disclosure is not limited to any particular shape, size, or distance between through-holes 358.

While FIGS. 3C-3E relate to embodiments of the connection points 350, 350' located on the first major surface 316*a* of the first strap 310, it should be understood that similar connection points 350, 350' may also be located on the second strap 320 and the third strap 330, as described herein.

In the embodiment depicted in FIG. 3A, only a portion of the first major surface 316*a* includes the connection points 350. That is, the connection points 350 cover only a portion of the first major surface 316*a* at a location between the proximal end 312 and the distal end 314 of the first strap 310. In some embodiments, the connection points 350 may be located on the first major surface 316*a* such that a distance between the connection points 350 and the distal end 314 of the first strap 310 is greater than a circumference of a body part of the subject S (FIG. 1) such that the distal end 314 of first strap 310 can be wrapped around the body part without hindering access to the connection points 350. Still referring to FIG. 3A, for example, the connection points 350 may extend along the first major surface 316*a* at a distance that is at least about 30 cm from the distal end 314 of the first strap 310, including about 30 cm, about 40 cm, about 50 cm, about 60 cm, about 70 cm, about 80 cm, about 90 cm, about 100 cm, or greater than 100 cm. In some embodiments, the connection points 350 may be positioned approximately equidistant from the proximal end 312 and the distal end 314 of the first strap 310. In some embodiments, the connection points 350 may extend across the entire first major surface 316*a* of the first strap 310. That is, substantially all of the first major surface 316*a* may include the connection points 350 thereon.

Referring again to FIGS. 3A and 3B, the second strap 320 is generally a strip of material having a proximal end 322 and a distal end 324 spaced a length $L_5$ from the proximal end 322. The length $L_5$ of the second strap 320 is generally not limited by this disclosure, and may be any length that allows the second strap 320 to extend from a sling bar and wrap around a portion of a subject (e.g., an arm or a leg of a subject), as described in greater detail herein. For example, the length $L_5$ of the second strap 320 may be from about 60 centimeters (cm) to about 180 cm, including about 60 cm, about 70 cm, about 80 cm, about 90 cm, about 100 cm, about 110 cm, about 120 cm, about 130 cm, about 140 cm, about 150 cm, about 160 cm, about 170 cm, about 180 cm, or any value or range between any two of these values (including endpoints). In some embodiments, the length $L_5$ of the second strap 320 may be substantially similar to the length $L_4$ of the first strap 310. In some embodiments, the length $L_5$ of the second strap 320 may be according to a particular type of support harness 300 (e.g., various lengths for small, medium, large, and extra-large subjects).

The general shape of the second strap 320 is not limited by the present disclosure, and may generally be any shape. For example, as depicted in the embodiment FIGS. 3A-3B, the second strap 320 is generally rectangular in shape, where the length $L_5$ of the second strap 320 is longer than a width $W_5$ of the second strap 320. In other embodiments, the second strap 320 has a generally rectangular shape with tapered ends. That is, the second strap 320 may be shaped such that sides of the second strap 320 taper to a point at the proximal end 322 and the distal end 324 thereof. In some embodiments, the second strap 320 may be shaped such that the length $L_5$ of the second strap 320 is generally a multiple greater than a width $W_5$ of the second strap 320. For example, the length $L_5$ of the second strap 320 may be about five times or more greater than the width $W_5$ of the second strap 320. In some embodiments, such a multiple may provide dimensions that aid in ease of placement of the second strap 320 underneath a subject. Certain other shapes that allow for ease of use in placing the second strap 320 underneath a subject are also contemplated and included within the scope of the present disclosure.

The second strap 320 includes a first major surface 326*a* and a second major surface 326*b* opposite the first major surface 326*a*. The first major surface 326*a* includes the connection points 350 thereon, as described hereinabove with respect to the first strap 310. In the embodiment depicted in FIG. 3A, only a portion of the first major surface 326*a* includes the connection points 350. That is, the connection points 350 cover only a portion of the first major surface 326*a* at a location between the proximal end 322 and the distal end 324 of the second strap 320. In some embodiments, the connection points 350 may be located on the first major surface 326*a* such that a distance between the connection points 350 and the distal end 324 of the second strap 320 is greater than a circumference of a body part of the subject S (FIG. 1) such that the distal end 324 of second strap 320 can be wrapped around the body part without hindering access to the connection points 350. Still referring to FIG. 3A, for example, the connection points 350 may extend along the first major surface 326*a* at a distance that is at least about 30 cm from the distal end 324 of the second strap 320, including about 30 cm, about 40 cm, about 50 cm, about 60 cm, about 70 cm, about 80 cm, about 90 cm, about 100 cm, or greater than 100 cm. In some embodiments, the connection points 350 may be positioned approximately equidistant from the proximal end 322 and the distal end 324 of the second strap 320. In some embodiments, the connection points 350 may extend across the entire first major surface 326*a* of the second strap 320. That is, substantially all of the first major surface 326*a* may include the connection points 350 thereon.

Referring again to FIGS. 3A and 3B, the third strap 330 is generally a strip of material having a proximal end 332 and a distal end 334 spaced a length $L_6$ from the proximal end 332. The length $L_6$ of the third strap 330 is generally not limited by this disclosure, and may be any length that allows the third strap 330 to extend from a sling bar and wrap around a portion of a subject (e.g., a torso of a subject), as described in greater detail herein. For example, the length $L_6$ of the third strap 330 may be from about 60 centimeters (cm) to about 300 cm, including about 60 cm, about 70 cm, about 80 cm, about 90 cm, about 100 cm, about 110 cm, about 120 cm, about 130 cm, about 140 cm, about 150 cm, about 160 cm, about 170 cm, about 180 cm, about 190 cm, about 200 cm, about 210 cm, about 220 cm, about 230 cm, about 240 cm, about 250 cm, about 260 cm, about 270 cm, about 280 cm, about 290 cm, about 300 cm or any value or range between any two of these values (including endpoints). In some embodiments, the length $L_6$ of the third strap 330 may be longer than the length $L_4$ of the first strap 310 and/or the length $L_5$ of the second strap 320. In some embodiments, the length $L_6$ of the third strap 330 may be according to a particular type of support harness 300 (e.g., various lengths for small, medium, large, and extra-large subjects).

The general shape of the third strap 330 is not limited by the present disclosure, and may generally be any shape. For example, as depicted in the embodiment FIGS. 3A-3B, the third strap 330 is generally rectangular in shape, where the length $L_6$ of the third strap 330 is longer than a width $W_6$ of the third strap 330. In other embodiments, the third strap 330 has a generally rectangular shape with tapered ends. That is, the third strap 330 may be shaped such that sides of the third strap 330 taper to a point at the proximal end 332 and the distal end 334 thereof. In some embodiments, the third strap 330 may be shaped such that the length $L_6$ of the third strap 330 is generally a multiple greater than a width $W_6$ of the third strap 330. For example, the length $L_6$ of the third strap 330 may be about five times or more greater than the width $W_6$ of the third strap 330. In some embodiments, such a multiple may provide dimensions that aid in ease of placement of the third strap 330 underneath a subject. Certain other shapes that allow for ease of use in placing the third strap 330 underneath a subject are also contemplated and included within the scope of the present disclosure.

The third strap 330 includes a first major surface **336*a* and a second major surface 336*b* opposite the first major surface 336*a*. The first major surface 336*a* of the third strap 330 includes the connection points 350 thereon, as described herein with respect to the first strap 310. In the embodiment depicted in FIG. 3A, only a portion of the first major surface 336*a* includes the connection points 350. That is, the connection points 350 cover only a portion of the first major surface 336*a* at a location between the proximal end 332 and the distal end 334 of the third strap 330. In some embodiments, the connection points 350 may be located on the first major surface 336*a* such that a distance between the connection points 350 and the distal end 334 of the third strap 330 is greater than a circumference of a body part of the subject S (FIG. 1), such that the distal end 334 of third strap 330 can be wrapped around the body part without hindering access to the connection points 350. Still referring to FIG. 3A, for example, the connection points 350 may extend along the first major surface 336*a* at a distance that is at least about 30 cm from the distal end 334 of the third strap 330, including about 30 cm, about 40 cm, about 50 cm, about 60 cm, about 70 cm, about 80 cm, about 90 cm, about 100 cm, or greater than 100 cm. In some embodiments, the connection points 350 may be positioned approximately equidistant from the proximal end 332 and the distal end 334 of the third strap 330. In some embodiments, the connection points 350 may extend across the entire first major surface 336*a* of the third strap 330. That is, substantially all of the first major surface 336*a* may include the connection points 350** thereon.

Referring to FIGS. 3A-3C, each of the first strap 310, the second strap 320, and the third strap 330 may include one of the connectors 352 at their respective distal ends 314, 324, 334 thereof. That is, the distal end 314 of the first strap 310 may have a connector 352 coupled thereto, the distal end 324 of the second strap 320 may have a connector 352 coupled thereto, and the distal end 334 of the third strap 330 may have a connector coupled thereto. The connectors 352 are generally a device that allows for mechanical coupling and release of the distal ends 314, 324, 334 of the first strap 310, the second strap 320, and the third strap 330, respectively, to the connection points 350 located on each of the first strap 310, the second strap 320, and the third strap 330. That is, a connector 352 may couple the distal end 314 of the first strap 310 to one of the connection points 350 on the first major surface **316*a* of the first strap 310, another connector 352 may couple the distal end 324 of the second strap 320 to one of the connection points 350 on the first major surface 326*a* of the second strap 320, and yet another connector 352 may couple the distal end 334 of the third strap 330 to one of the connection points 350 on the first major surface 336*a* of the third strap 330. The connectors 352 may be fixed to the distal ends 314, 324, 334 of the first strap 310, the second strap 320, and the third strap 330, respectively, or may be removably coupled to the distal ends 314, 324, 334 of the first strap 310, the second strap 320, and the third strap 330**, respectively.

The connectors 352 may each be any type of fastener that can be releasably coupled to one of the connection points 350 on the first strap 310, the second strap 320, or the third strap 330. Illustrative examples of fasteners include, but are not limited to, shackles, carabiners, buckles, clamps, clasps, hooks, latches, ties, or the like. FIGS. 3A-3C depict the connectors 352 as carabiners that have a metal loop with a spring loaded gate that can be coupled to one of the connection points 350 and can be removed by overcoming the biasing force of the spring loaded gate to open the carabiner and disconnect from the connection point 350.

Each of the first strap 310, the second strap 320, and the third strap 330 may be constructed of a type of material that allows the straps 310, 320, 330 to be flexible such that the straps 310, 320, 330 can be manipulated (e.g., rolled up, folded, twisted, and/or the like). For example, as shown in FIG. 3C, the flexible material of the first strap 310 may allow the first strap 310 to be manipulated such that the connector 352 can be coupled to the connection points 350, thereby forming a loop that can hold a portion of a subject (e.g., an arm or a leg of a subject), as described in greater detail herein. While FIG. 3C only depicts the first strap 310 as being manipulated into a loop configuration, it should be understood that the second strap 320 and the third strap 330 may also be manipulated in a similar manner. Referring again to FIGS. 3A-3B, in some embodiments, the straps 310, 320, 330 may be formed from a textile comprising natural fibers that are derived from animal (protein), vegetable (cellulose), and/or mineral sources. Illustrative examples of natural fibers include, but are not limited to, cellulose (staple) fibers such as bast, leaf, seed hair, cane, grass, and reed; protein (staple) fibers such as hair, wool, and/or filaments (e.g., secretions such as silk); and mineral fibers such as asbestos, glass, gold, silver, and/or the like. In some embodiments, the straps 310, 320, 330 may be formed from one or more manufactured fibers such as manmade (human made), regenerated, or synthetic fibers having a chemical composition that is organic or inorganic or derivatives thereof. In some embodiments the straps 310, 320, 330 may be formed from one or more fibers having a chemical composition that is organic or inorganic. Illustrative examples of organic polymer fibers from natural sources include, but are not limited to, acetate, alginate, cupro, elastodiene, lyocell, model, triacetate, and viscose. Illustrative examples of organic fibers made from synthetic polymers include, but are not limited to, acrylic, aramid, chlorofibre, elastane, elastodiene, elastoelfin, elastomultiester, flurofiber, melamine, modacrylic, polyamide, polyester, polyethelene, polyimide, polylactic acid, polypropylene, polypropylene/polyamide biocomponent, and vinylal. Illustrative examples of inorganic fibers include, but are not limited to, carbon, ceramic, glass, and metal.

Still referring to FIGS. 3A and 3B, the first connection piece 342 and the second connection piece 344 of the support harness 300 are arranged such that the first connection piece 342 extends between and connects the first strap 310 to the third strap 330 and the second connection piece 344 extends between and connects the second strap 320 to the third strap 330. More specifically, the first connection piece 342 may be coupled to a portion of the first strap 310 at the proximal end 312 thereof (or to an extension component extending from the proximal end 312 of the first strap 310) and may be coupled to a portion of the third strap 330 at the proximal end 332 thereof (or to an extension component extending from the proximal end 332 of the third strap 330). In addition, the second connection piece 344 may be coupled to a portion of the second strap 320 at the proximal end 322 thereof (or to an extension component extending from the proximal end 322 of the second strap 320) and may be coupled to a portion of the third strap 330 at the proximal end 332 thereof (or to an extension component extending from the proximal end 332 of the third strap 330). In some embodiments, the first connection piece 342 may be coupled to the first strap 310 and the third strap 330 via stitching, bonding, welding (e.g., radio frequency welding), attachment via adhesive, and/or the like. In other embodiments, the first connection piece 342 may be integrated as part of the first strap 310 and/or the third strap 330. That is, the first connection piece 342 may a component of the first strap 310 and/or the third strap 330 that extends from the first strap 310 and/or the third strap 330 such that the first strap, 310, the first connection piece 342, and the third strap 330 are all formed as a single component. In some embodiments, the second connection piece 344 may be coupled to the second strap 320 and the third strap 330 via stitching, bonding, welding (e.g., radio frequency welding), attachment via adhesive, and/or the like. In other embodiments, the second connection piece 344 may be integrated as part of the second strap 320 and/or the third strap 330. That is, the second connection piece 344 may a component of the second strap 320 and/or the third strap 330 that extends from the second strap 320 and/or the third strap 330 such that the second strap, 320, the second connection piece 344, and the third strap 330 are all formed as a single component. In some embodiments, the first strap 310, the first connection piece 342, the third strap 330, the second connection piece 344, and the second strap 320 may all be formed as a one piece assembly.

Still referring to FIGS. 3A and 3B, in various embodiments, the support harness 300 generally includes at least one first loop 346 extending from the proximal end 312 of the first strap 310 and at least one second loop 348 extending from the proximal end 322 of the second strap 320. The loops 346, 348 each provide a connection point for the support harness 300 to be connected to another object. For example, in the embodiments described herein, the loops 346, 348 are used as a connection point for connecting the support harness 300 to the sling bar 160 (FIG. 1). The first loop 346 is coupled to the proximal end 312 of the first strap 310 (or to an extension component extending from the proximal end 312 of the first strap 310) by any means of coupling, including, but not limited to, stitching, welding, use of fasteners (e.g., rivets or the like), use of adhesives, and/or the like. In addition, the second loop 348 is coupled to the proximal end 322 of the second strap 320 (or to an extension component extending from the proximal end 322 of the second strap 320) by any means of coupling, including, but not limited to, stitching, welding, use of fasteners (e.g., rivets or the like), use of adhesives, and/or the like. In some embodiments, the loops 346, 348 are integrated with the first strap 310 and the second strap 320, respectively. That is, the loops 346, 348 are formed as an extension of the material of the first strap 310 and the second strap 320, respectively, such that the first strap 310 and the second strap 320 (including the loops 346, 348) are all formed from a single piece of material. In some embodiments, the loops 346, 348 may be formed as an extension of a piping material that surrounds the various edges of the first strap 310 and the second strap 320.

The loops 346, 348 may generally be constructed of any type of material, and such materials are not limited by the present disclosure. In some embodiments, the loops may be constructed of a material that has load bearing properties that allow the support harness 300, together with the loops 346, 348, to support the weight of a human subject. In some embodiments, the loops may be formed from a textile comprising natural fibers that are derived from animal (protein), vegetable (cellulose), and/or mineral sources. Illustrative examples of natural fibers include, but are not limited to, cellulose (staple) fibers such as bast, leaf, seed hair, cane, grass, and reed; protein (staple) fibers such as hair, wool, and/or filaments (e.g., secretions such as silk); and mineral fibers such as asbestos, glass, gold, silver, and/or the like. In some embodiments, the straps 310, 320, 330 may be formed from one or more manufactured fibers such as manmade (humanmade), regenerated, or synthetic fibers having a chemical composition that is organic or inorganic or derivatives thereof. In some embodiments the straps 310, 320, 330 may be formed from one or more fibers having a chemical composition that is organic or inorganic. Illustrative examples of organic polymer fibers from natural sources include, but are not limited to, acetate, alginate, cupro, elastodiene, lyocell, model, triacetate, and viscose. Illustrative examples of organic fibers made from synthetic polymers include, but are not limited to, acrylic, aramid, chlorofibre, elastane, elastodiene, elastoelfin, elastomultiester, flurofiber, melamine, modacrylic, polyamide, polyester, polyethelene, polyimide, polylactic acid, polypropylene, polypropylene/polyamide biocomponent, and vinylal. Illustrative examples of inorganic fibers include, but are not limited to, carbon, ceramic, glass, and metal. In still other embodiments, the loops 346, 348 may be metal or plastic loops, such as, for example, metallic or plastic torus shaped rings.

Still referring to FIGS. 3A and 3B, in some embodiments, the support harness 300 may be constructed such that the first major surfaces 316*a*, 326*a*, 336*a* of the first strap 310, the second strap 320, and the third strap 330, respectively, are each constructed of or coated with a high-friction material and the second major surfaces 316*b*, 326*b*, 336*b*, of the first strap 310, the second strap 320, and the third strap 330, respectively, are constructed of or coated with a low-friction material. The low-friction material is generally any material having a coefficient of friction that is lower than a coefficient of friction of the high-friction material. In some embodiments, the low-friction material may be any material that has a coefficient of friction that is lower than a coefficient of friction of an uncoated or untreated surface of the support harness 300. In some embodiments, the high-friction material may be any material that has a coefficient of friction that is the same or higher than a coefficient of friction of an uncoated or untreated surface of the support harness. The coefficient of friction is a quantitative measure of the friction between two surfaces, including the first major surfaces 316*a*, 326*a*, 336*a* and the second major surfaces 316*b*, 326*b*, 336*b*, including surface roughness, and environmental conditions such as, but not limited to, temperature and humidity. In some embodiments, the coefficient of friction refers to a maximum coefficient of friction measured at a normal load of 30 N as measured in a standard test equipment, such as, for example, a vial overlay test jig. In one example, a low coefficient of friction may be about 0.9 or less relative to an uncoated surface, including, about 0.9, about 0.8, about 0.7, about 0.6, about 0.5, about 0.4, about 0.3, about 0.2, about 0.1 or less relative to an uncoated surface, or any range or value between any two of these values. In another example, a high coefficient of friction may be about 1.0 or greater relative to an uncoated surface, including about 1.0, about 1.5, about 2.0, about 2.5, about 3.0, about 3.5, about 4.0 or greater relative to an uncoated surface, or any range or value between any two of these values. In some embodiments, the first major surfaces 316*a*, 326*a*, 336*a* having the low-friction material may be constructed such that a low-friction coating on the second major surfaces 316*b*, 326*b*, 336*b* is directional. That is, for example, the second major surfaces 316*b*, 326*b*, 336*b* may each exhibit a lower coefficient of friction along the respective lengths $L_4$, $L_5$, $L_6$ of the straps 310, 320, 330 relative to a coefficient of friction along the respective widths $W_4$, $W_5$, $W_6$ of the straps 310, 320, 330.

In some embodiments, the support harness 300 may be arranged relative to the subject such that the first major surfaces 316*a*, 326*a*, 336*a* having the high-friction material faces the subject and the second major surfaces 316*b*, 326*b*, 336*b* having the low-friction material face the surface upon which the subject is laying. Such an arrangement may allow the support harness 300 to be more easily slid underneath the subject (e.g., such that the low-friction surfaces slide more easily along the support surface) relative to a surface not having the low friction material thereon or integrated therewith. Further, the high-friction material may retain a grip on the subject to avoid slippage, particularly when the subject is lifted.

Still referring to FIGS. 3A and 3B, in some embodiments, the support harness 300 may have indicia thereon. The location and type of indicia is not limited by the present disclosure, and may generally be any location and type. In some embodiments, the indicia may provide an indication of an arrangement of various straps of the support harness 300 with respect to a subject. That is, the indicia may provide one or more indicators to a user about how to position the subject with respect to the first strap 310, the second strap 320, and/or the third strap 330. Illustrative examples of indicia include, but are not limited to, lines, shapes, images, text, anatomical drawings, measurement marks (e.g., a ruler), or the like. In some embodiments, the indicia may be color coded or otherwise visually distinguishable for the purposes of indicating a particular arrangement, positioning, and/or the like of the first strap 310, the second strap 320, and/or the third strap 330.

It should be understood that the components of the support harness 300 are merely illustrative, and other components, including additional components and alternative components that provide support to a subject as described herein are contemplated and included within the scope of the present disclosure.

FIGS. 4A-4D depict an illustrative support plate 400 that may be coupled to one of the straps of the support harnesses described herein. While FIGS. 4A-4D show the support plate 400 in relation to the first strap 310 of the embodiments of FIGS. 3A-3E, this is merely illustrative. Any of the straps discussed herein may receive the support plate 400. In some embodiments, any one of the straps of the support harnesses described herein may have a support plate 400 thereon, and a plurality of support plates 400 may be placed on a support harness (e.g., a support plate 400 on each strap of a support harness, a plurality of support plates 400 on a strap, or the like). As described herein, the support plate 400 may be attached to one of the straps such that the support plate 400 is movable (e.g., positionable) along the length of the strap such that the support plate 400 can be adjusted with respect to the strap and/or the subject.

The support plate 400 is generally a planar component that provides additional surface area at one or more contact points between the various straps of the support harness with the subject. Referring now to FIGS. 4A and 4B, the support plate 400 includes an elongate body 402 having a first major surface 404 and a second major surface 406 (FIG. 4B) opposite the first major surface 404. The first major surface 404 generally includes a support pad 408 thereon and the second major surface 406 generally includes a retention component 410.

While the elongate body 402 of the support plate 400 is depicted in the embodiment of FIG. 4A as being generally rectangular and having rounded corners, the present disclosure is not limited to such. That is, the elongate body 402 may be constructed to have any general shape or size without departing from the scope of the present application. In some embodiments, a width $W_7$ of the elongate body 402 may be greater than a width of a strap upon which the support plate 400 is attached (e.g., width $W_4$ of the first strap 310 as depicted in FIG. 4A). Such a width $W_7$ of the elongate body 402 allows for a contact area with a subject that is greater than a contact area provided by the first strap 310 without the support plate 400 coupled thereto.

In some embodiments, the elongate body 402 may be constructed of a rigid material that maintains its shape when pressed against a subject. In other embodiments, the elongate body 402 may be constructed of a semi-rigid material that flexes and deforms when pressed against a subject. Illustrative examples of materials that may be used to form the rigid material include various polymers (e.g., polyethylene terephthalate (PETE or PET), polyethylene (PE), polyvinyl chloride (PVC), polypropylene (PP), polystyrene (PS), polylactic acid (PLA), polycarbonate (PC), acrylic (PMMA), and/or the like, as well as combinations and mixtures thereof), metals, resins, ceramics, and/or the like. Other materials are contemplated and included within the scope of the present disclosure.

In some embodiments, the first major surface 404 may support the support pad 408 thereon. The support pad 408 is generally a piece of shock absorbing material that extends across at least a portion of the first major surface 404 of the elongate body 402. In some embodiments, the support pad 408 may extend across an entire area of the first major surface 404. In other embodiments, the support pad 408 may extend across less than an entire area of the first major surface 404.

In some embodiments, the support pad 408 may be attached to the first major surface 404 of the elongate body 402 via any means of permanent, semi-permanent, or temporary fixture. For example, in some embodiments, the support pad 408 may be attached to the first major surface 404 via an adhesive, snaps, clips, a hook-and-loop mechanism, and/or the like. In other embodiments, the support pad 408 may be integrated with the first major surface 404. In still other embodiments, the elongate body 402 may be at least partially constructed of the support pad 408. In some embodiments, the support pad 408 may be placed on the first major surface 404 and compressed against the first major surface 404 when the support plate 400 is placed adjacent to the subject (e.g., the weight of the subject against the support plate 400 compresses the support pad 408 therebetween).

The shock absorbing material used for the support pad 408 is not limited by the present disclosure, and may generally be any material. In some embodiments, the shock absorbing material may be a foam. Illustrative examples of materials include, but are not limited to, polyurethane, polystyrene, phenolic resin, rubber, combinations thereof, mixtures thereof, or the like. Other materials are contemplated and included within the scope of the present disclosure.

Figure 4C:
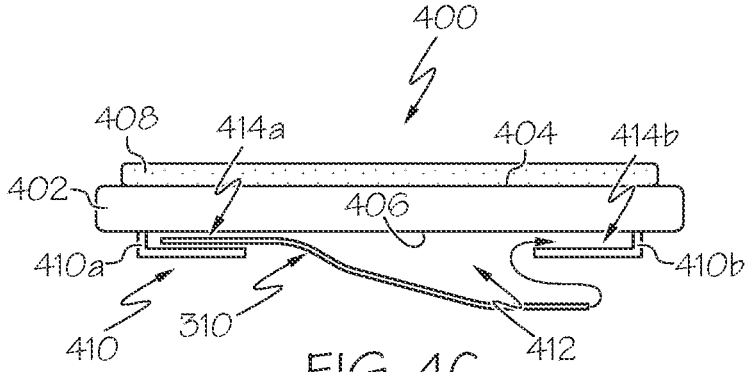
FIG. 4C depicts a side view of the illustrative strap of the support harness when partially attached to the detachable support plate of FIG. 4A according to one or more embodiments shown and described herein.
Figure 4D:
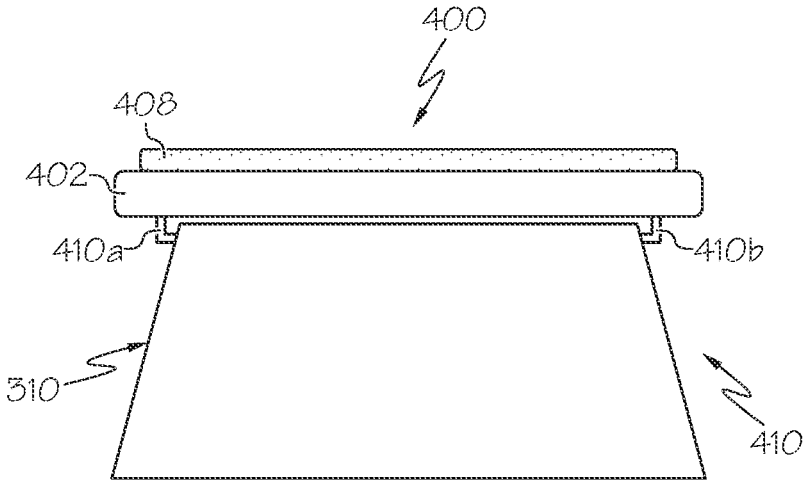
FIG. 4D depicts a side view of the illustrative strap of the support harness when attached to the detachable support plate of FIG. 4A according to one or more embodiments shown and described herein.

Turning to FIGS. 4B-4D, the retention component 410 on the second major surface 406 of the body 402 is generally shaped and sized to receive a strap from the harness (e.g., the first strap 310) to couple the support plate to the strap and allow the support plate 400 to move along the length of the strap (e.g., such that the location of the support plate 400 with respect to the strap and/or a subject can be adjusted). In the embodiment depicted in FIGS. 4B-4D, the retention component 410 includes a first arm 410*a* and a second arm 410*b*, the first arm 410*a* and the second arm 410*b* extending from the second major surface 406 of the body 402. The first arm 410*a* and the second arm 410*b* may be angled, curved, and/or the like such that a portion of the first arm 410*a* and a portion of the second arm 410*b* extend toward one another to define an opening 412 therebetween. In addition, the first arm 410*a* is angled, curved, and/or the like to define a first pocket 414*a* between the first arm 410*a* and the second major surface 406 of the body 402 and the second arm 410*b* is angled, curved, and/or the like to define a second pocket 414*b* between the second arm 410*b* and the second major surface 406 of the body 402.

As depicted in FIG. 4C, the opening 412 may be sufficiently sized and shaped so that the strap (e.g., the first strap 310) can be received therein (e.g., between the first arm 410*a* and the second arm 410*b*). More specifically, FIG. 4C depicts the first strap 310 being placed within the opening 412 such that a first side thereof extends into the first pocket 414*a*. The first strap 310 is then deformed such that a second side opposite the first side can be placed into the second pocket 414*b*, as indicated by the arrow in FIG. 4C. As a result of this motion, the first arm 410*a* and the second arm 410*b* hold the support plate 400 on the first strap 310, as depicted in FIG. 4D. It should be understood that the retention component 410 depicted in FIG. 4D is merely one illustrative example of a component that holds the support plate 400 on the strap 310. Other examples are contemplated, including embodiments that utilize pivot arms, snaps, clips, and/or the like to hold the support plate 400 on the strap 310.

FIG. 5 depicts a flow diagram of an illustrative method of arranging the subject S with one or more support harnesses and moving and/or rotating the subject S accordingly, and FIGS. 6A-6C depict various views of a subject S supported by one or more support harnesses. More specifically, FIG. 6A depicts a perspective view of a subject S supported by a single support harness (e.g., support harness 200 of FIGS. 2A-2B), FIG. 6B depicts a perspective view of a subject S supported by two support harnesses 200(1), 200(2), and FIG. 6C depicts a top view of the subject S supported by the two support harnesses (e.g., a first support harness 200(1) and a second support harness 200(2)).

Turning to FIG. 5, with reference to FIGS. 6A-6C, at block 502, the support harness is coupled to the sling bar 160. That is, in the embodiment depicted in FIG. 6A (e.g., embodiments where a single support harness 200 is used), the at least one first loop 246 is coupled to the first retention component 164 at the first end 162 of the sling bar 160 and the at least one second loop 248 is coupled to the second retention component 168 at the second end 166 of the sling bar 160. In the embodiment depicted in FIG. 6B (e.g., embodiments where two support harnesses 200(1), 200(2) are used), the at least one first loop 246(1) and the at least one second loop 248(1) of the first support harness 200(1) are coupled to the first retention component 164 at the first end 162 of the sling bar 160 and the at least one first loop 246(2) and the at least one second loop 248(2) of the second support harness 200(2) are coupled to the second retention component 168 at the second end 166 of the sling bar 160. Coupling of the various loops to the various retention components may include, for example, slipping the loops over an open end of the retention components. While FIG. 5 depicts block 502 occurring before the various other processes, this is merely illustrative. That is, in some embodiments, the support harness may not be coupled to the sling bar 160 until after the processes described herein with respect to blocks 504-518 have been completed, but before completing the process according to block 520.

Still referring to FIG. 5 with reference to FIGS. 6A-6C, at block 504, the center strap is arranged around the subject S. That is, in the embodiment depicted in FIG. 6A (e.g., embodiments where a single support harness 200 is used), the third strap 230 may be positioned at a location around the subject S and attached to itself by joining the first portion 250 (FIG. 2A) and the second portion 252 (FIG. 2B) of the hook-and-loop fastener. For example, the distal end 234 (FIGS. 2A-2B) of the third strap 230 may be wrapped around the hips 606 of the subject S and secured by joining the portions of the hook-and-loop fastener together such that the hips 606 are held within the loop formed therefrom, as described herein. While not depicted in FIG. 6A, in embodiments where support harness 300 (FIGS. 3A-3B) is used, the distal end 334 of the third strap 330 may be wrapped around the hips 606 of the subject S and the connector 352 may be joined to one of the connection points 350, as described herein. In the embodiment depicted in FIG. 6B (e.g., embodiments where the first support harness 200(1) and the second support harness 200(2) are used), the third strap 230(1) of the first support harness 200(1) may be positioned at a location around the subject S (e.g., the hips 606 of the subject S) and attached to itself as described herein. As depicted in FIG. 6B, the third strap 230(2) of the second support harness 200(2) is rolled up and is not secured around the subject S. However, it should be understood that the third strap 230(2) of the second support harness 200(2) may also be secured around the subject S in some embodiments.

At blocks 506 and 510, determinations are made as to whether no side straps will be used, a single side strap will be used, or both side straps will be used. For example, at block 506, a determination is made as to whether at least one side strap will be used. That is, a determination is made at block 506 as to whether at least one of the first strap 210 and the second strap 220 are to be wrapped around the subject S in the embodiment depicted in FIG. 6A. In the embodiment depicted in FIG. 6B, the determination according to block 506 includes determining whether at least one of the first strap 210(1) and the second strap 220(1) of the first support harness 200(1) are to be wrapped around the subject S and whether at least one of the first strap 210(2) and the second strap 220(2) of the second support harness 200(2) are to be wrapped around the subject S. If at least one side strap is to be used according to the determination at block 506 (e.g., "YES"), the process moves to block 510. If neither side strap is to be used according to the determination at block 506 (e.g., "NO"), the process moves to block 508.

At block 508, the unused side straps may be arranged away from the subject S. That is, in embodiments employing a single support harness 200, the first strap 210 and the second strap 220 may be rolled up and secured or otherwise placed such that the straps 210, 220 are positioned away from the subject S or are otherwise not interfering with the lifting operations described herein. In embodiments employing a plurality of support harnesses (e.g., the first support harness 200(1) and the second support harness 200(2)), the first strap 210(1) and the second strap 220(1) of the first support harness 200(1) and the first strap 210(2) and the second strap 220(2) of the second support harness 200(2) may be rolled up and secured or otherwise placed such that the straps are positioned away from the subject S or otherwise not interfering with the lifting operations described herein. The process according to block 508 is depicted in FIG. 5 in phantom because the process may be omitted in some embodiments. That is, the various straps may optionally be allowed to hang without arrangement away from the subject S in some embodiments. Regardless of whether the process according to block 508 is completed, the process continues at block 520, as described herein.

At block 510, a determination is made as to whether both side straps will be used. That is, a determination is made at block 510 as to whether only one of the first strap 210 and the second strap 220 are to be wrapped around the subject S or both of the first strap 210 and the second strap are to be wrapped around the subject S in the embodiment depicted in FIG. 6A. In the embodiment depicted in FIG. 6B, the determination according to block 510 includes determining whether only one or both of the first strap 210(1) and the second strap 220(1) of the first support harness 200(1) are to be wrapped around the subject S and whether only one or both of the first strap 210(2) and the second strap 220(2) of the second support harness 200(2) are to be wrapped around the subject S. If both side straps are used according to the determination at block 510 (e.g., "YES"), the process moves to block 516. If only one of the side straps are used (e.g., at least one is not being used), the process moves to block 512.

At block 512, the one strap that is used is arranged around the subject S. That is, in the embodiment depicted in FIG. 6A (e.g., embodiments where a single support harness 200 is used), one of the first strap 210 and the second strap 220 may be positioned at a location around the subject S and attached to itself by joining the first portion 250 (FIG. 2A) and the second portion 252 (FIG. 2B) of the hook-and-loop fastener. For example, the distal end 214 of the first strap 210 may be positioned underneath the subject S (e.g., between the subject S and the support surface 120 (FIG. 1)) and wrapped around a thigh 602 of the subject S (e.g., a left thigh or a right thigh) and secured by joining the portions of the hook-and-loop fastener together such that the thigh 602 is held within the loop formed therefrom, as described herein. As such, the first strap 210 extends underneath both thighs of the subject and is secured around one of the subject's thighs, as depicted in FIG. 6A. In another example, the distal end 224 of the second strap 220 may be positioned underneath the subject S (e.g., between the subject S and the support surface 120 (FIG. 1)) and wrapped around an upper arm 604 (e.g., adjacent to the shoulder or armpit) of the subject S (e.g., a left arm or a right arm) and secured by joining the portions of the hook-and-loop fastener together such that the upper arm 604 is held within the loop formed therefrom, as described herein. As such, the second strap 220 extends underneath both arms and the torso of the subject and secured around one of the subject's arms, as depicted in FIG. 6A. While not depicted in FIG. 6A, in embodiments where support harness 300 (FIGS. 3A-3B) is used, the distal end 314 of the first strap 310 may extend underneath the subject S and may be wrapped around the thigh 602 of the subject S or the distal end 324 of the second strap 320 may extend underneath the subject S and may be wrapped around the upper arm 604 of the subject S and the respective connectors 352 may be joined to one of the connection points 350, as described herein.

In the embodiment depicted in FIGS. 6B-6C (e.g., embodiments where the first support harness 200(1) and the second support harness 200(2) are used), the first strap 210(1) of the first support harness 200(1) may be positioned at a location around the subject S (e.g., a first thigh 602*a* of the subject S) and attached to itself, or the second strap 220(1) of the first support harness 200(1) may be positioned at a location around the subject S (e.g., a second thigh 602*b* of the subject S) and attached to itself as described herein. Similarly, the first strap 210(2) of the second support harness 200(2) may be positioned at a location around the subject S (e.g., a first arm 604*a* of the subject S) and attached to itself, or the second strap 220(2) of the second support harness 200(2) may be positioned at a location around the subject S (e.g., a second arm 604*b* of the subject S) and attached to itself as described herein. While not depicted in FIGS. 6B-6C, use of support harness 300 depicted in FIGS. 3A-3B (or a plurality of support harness 300) may be used in a similar manner.

Still referring to FIG. 5 and FIGS. 6A-6C, at block 514, the at least one unused side strap may be arranged away from the subject S. That is, in embodiments employing a single support harness 200, at least one of the first strap 210 and the second strap 220 may be rolled up and secured or otherwise placed such that the at least one strap is positioned away from the subject S or is otherwise not interfering with the lifting operations described herein. In embodiments employing a plurality of support harnesses (e.g., the first support harness 200(1) and the second support harness 200(2)), at least one of the first strap 210(1) and the second strap 220(1) of the first support harness 200(1) and/or at least one of the first strap 210(2) and the second strap 220(2) of the second support harness 200(2) may be rolled up and secured or otherwise placed such that the straps are positioned away from the subject S or otherwise not interfering with the lifting operations described herein. The process according to block 514 is depicted in FIG. 5 in phantom because the process may be omitted in some embodiments. That is, the various straps may optionally be allowed to hang without arrangement away from the subject S in some embodiments. Regardless of whether the process according to block 514 is completed, the process continues at block 520, as described herein.

At blocks 516 and 518, the various straps are arranged around the subject S. That is, in the embodiment depicted in FIG. 6A, at block 516, the first strap 210 may be arranged around a thigh 602 of the subject S and at block 518, the second strap 220 may be arranged around an upper arm 604 of the subject S. In some embodiments, the straps 210, 220 may be arranged to cause a particular rotation of the subject. That is, the straps 210, 220 may be placed underneath the subject S and then wrapped around the subject S on a side of the subject S that corresponds to a desired direction of rotation RD (depicted by the arrow in FIG. 6A). For example, if the desired direction of rotation RD is to the left of the subject S (as shown in FIG. 6A), the straps 210, 220 may be placed underneath the subject S (e.g., between the subject S and the support surface 120 (FIG. 1)) and wrapped around the subject's left side extremities. That is, the first strap 210 is arranged underneath the subject S and around a left thigh of the subject S at block 516 and the second strap 220 is arranged underneath the subject S and around a left arm of the subject S at block 518. In another example, if the desired direction of rotation RD is to the right of the subject S (not shown in FIG. 6A), the straps 210, 220 may be placed underneath the subject S (e.g., between the subject S and the support surface 120 (FIG. 1)) and wrapped around the subject's right side extremities. That is, the first strap 210 is arranged underneath the subject S and around a right thigh of the subject S at block 516 and the second strap 220 is arranged underneath the subject S and around a right arm of the subject S at block 518. While not depicted in FIG. 6A, in embodiments where support harness 300 (FIGS. 3A-3B) is used, the distal end 314 of the first strap 310 may extend underneath the subject S and may be wrapped around the thigh 602 of the subject S and the distal end 324 of the second strap 320 may extend underneath the subject S and may be wrapped around the upper arm 604 of the subject S and the respective connectors 352 may be joined to one of the connection points 350, as described herein.

While blocks 516 and 518 of FIG. 5 generally relate to the embodiment depicted in FIG. 6A, it should be understood that similar processes may be completed for the embodiment depicted in FIGS. 6B-6C (e.g., embodiments where the first support harness 200(1) and the second support harness 200(2) are used). That is, the first strap 210(1) of the first support harness 200(1) may be positioned at a location around the subject S (e.g., a first thigh 602*a* of the subject S) and attached to itself, and the second strap 220(1) of the first support harness 200(1) may be positioned at a location around the subject S (e.g., a second thigh 602*b* of the subject S) and attached to itself as described herein. Similarly, the first strap 210(2) of the second support harness 200(2) may be positioned at a location around the subject S (e.g., a first arm 604*a* of the subject S) and attached to itself, and the second strap 220(2) of the second support harness 200(2) may be positioned at a location around the subject S (e.g., a second arm 604*b* of the subject S) and attached to itself as described herein. While not depicted in FIGS. 6B-6C, use of support harness 300 depicted in FIGS. 3A-3B (or a plurality of support harness 300) may be used in a similar manner.

In the embodiment depicted in FIG. 6A, as a result of positioning the various straps with respect to the subject S as described herein with respect to blocks 504, 512, 516, and 518, the straps are arranged such that they are substantially parallel to one another to support the subject S in a lateral recumbent position, as explained hereinbelow with respect to blocks 520 and 522.

Referring to FIGS. 1, 5, and 6A, the overhead lift 150 may be operated at block 520. That is, the overhead lift 150 may be controlled by a user to pay out the lifting strap 152, thereby lowering the sling bar 160, and/or take up the lifting strap 152, thereby raising the sling bar 160. For example, in the embodiment depicted in FIG. 6A, operating the overhead lift 150 to raise the sling bar 160 may cause the subject S to rotate from a supine positioning to a positioning whereby the left shoulder, left hip, left arm, left side of the torso, and the like of the subject S remain in contact with the support surface 120 of the person support apparatus 110 and the right shoulder, right hip, right arm, right side of the torso, and the like of the subject S are raised off the support surface 120 of the person support apparatus 110 to move the subject S towards a lateral recumbent position (e.g., a side-lying position). In such an embodiment, the process may proceed to block 522 where the subject S is moved. That is, the subject S may be moved according to block 522 in a lateral direction across the width of the support surface 120 in a direction opposite of the "turn toward" side (e.g., opposite the desired direction of rotation RD). For example, in the embodiment depicted in FIG. 6A where the "turn toward" side of the person support apparatus 110 is the left hand side thereof, the subject S may be moved laterally toward the right hand side of the person support apparatus 110. Such a repositioning generally occurs as the subject S is rotating from the supine position to the lateral recumbent position or once the subject S has rotated to the lateral recumbent position. Movement of the subject S in such a manner according to block 522 is generally completed to provide sufficient space on the support surface 120 of the person support apparatus 110 to complete the remaining rotational movements, as described below.

Once the subject S has been moved according to block 522 (if the subject S is being moved), the process may return to block 520 for further operation of the overhead lift 150. For example, the overhead lift 150 may be operated to pay out the lifting strap 152, thereby lowering the sling bar 160, which causes the subject S to rotate. That is, the subject S rotates from the side laying (e.g., lateral recumbent) positioning towards a prone position. In some embodiments, intervention from one or more caretakers (e.g., the first individual $C_1$ and/or the second individual $C_2$ (FIG. 1)) may also be provided during downward movement to ensure appropriate rotation of the subject S toward the prone position. While the present disclosure specifically describes a process for rotating the subject from a supine position to a prone position, it should be understand that rotation in the opposite direction (e.g., from a prone position to a supine position) is also possible by completing the processes described herein.

Referring to the embodiment of FIGS. 6B-6C (with reference to FIGS. 1 and 5), operating the overhead lift 150 according to block 520 may include causing the overhead lift 150 to take up the lifting strap 152 to lift the subject S (e.g., lift the subject S off the support surface 120 of the person support apparatus 110 (FIG. 1)), as one example. As another example, operating the overhead lift 150 according to block 520 may include causing the lift to pay out the lifting strap 152 to lower the subject S (e.g., lower the subject S onto the support surface 120 of the person support apparatus 110 (FIG. 1)).

In some embodiments, the embodiment of FIG. 6A including the support harness 200 may be packaged as a system that includes the support harness 200 (or alternatively, support harness 300 of FIGS. 3A-3B)). That is, a lifting system may include at least the support harness 200 (or alternatively, support harness 300 of FIGS. 3A-3B)). Referring also to FIG. 1, in some embodiments, the lifting system may further include, in addition to the support harness 200, the overhead lift 150, the sling bar 160, and/or the support plate 400 (FIG. 4A). In some embodiments, a kit of parts may include the support harness 200 (or alternatively, support harness 300 of FIGS. 3A-3B)) and one or more instructions for arranging the first support harness 200 with respect to a subject, such as instructions encompassing one or more of the processes described herein with respect to FIG. 5. The kit of parts may also include at least one support plate 400 (FIG. 4A) in some embodiments.

In some embodiments, the embodiment of FIGS. 6B and 6C including the first support harness 200(1) and the second support harness 200(2) may be packaged as a system that includes the first support harness 200(1) and the second support harness 200(2) (or alternatively/in addition, support harness 300 of FIGS. 3A-3B)). That is, a lifting system may include at least the first support harness 200(1) and the second support harness 200(2). Referring also to FIGS. 1 and 4A, in some embodiments, the lifting system may further include, in addition to the first support harness 200(1) and the second support harness 200(2), the overhead lift 150, the sling bar 160, and/or one or more support plates. In some embodiments, a kit of parts may include the first support harness 200(1) and the second support harness 200(2) and one or more instructions for arranging the first support harness 200(1) and the second support harness 200(2) with respect to a subject, such as instructions encompassing one or more of the processes described herein with respect to FIG. 5. The kit of parts may also include at least one support plate 400 (FIG. 4A) in some embodiments.

It should now be understood that the present disclosure relates to various support harnesses that are customized for the purposes of manipulating a subject, such as raising/lowering a subject, rotating a subject from a prone position to a supine position, and/or rotating a subject from a supine position to a prone position using one or more overhead lifts. The support harnesses described herein generally have a plurality of straps that have connection features thereon for wrapping each one of the plurality of straps around a subject. In addition, each of the straps can receive one or more detachable support plates to provide support to a subject. Users utilizing the support harnesses described herein can easily arrange the support harness on a subject and connect the support harness to an overhead lift so that a rotating and/or lifting process can be completed.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A support harness having features to aid in lifting or rotating a horizontally positioned subject, the support harness comprising:

a plurality of straps comprising:

a first strap having a distal end and a proximal end, the first strap having connection features that connect the distal end to a portion of the first strap;

a second strap having a distal end and a proximal end, the second strap having connection features that connect the distal end to a portion of the second strap; and a third strap having a distal end and a proximal end, the third strap having connection features that connect the distal end to a portion of the third strap, the plurality of straps arranged such that the first strap, the second strap, and the third strap are spaced apart from one another, and the third strap extends between the first strap and the second strap;

a first connection piece extending between the proximal end of the first strap and the proximal end of the third strap, the first connection piece coupling the first strap to the third strap; and a second connection piece extending between the proximal end of the second strap and the proximal end of the third strap, the second connection piece coupling the second strap to the third strap, wherein the third strap is supported by the first strap and the second strap via the first connection piece and the second connection piece, and wherein the first strap, the second strap, and the third strap are each positionable around the horizontally positioned subject by wrapping the respective distal ends around a body part of the horizontally positioned subject and coupling the distal ends to the respective portions.

2. The support harness of claim 1, wherein the connection features of the first strap, the connection features of the second strap, and the connection features of the third strap each comprise portions of a hook-and-loop fastener.

3. The support harness of claim 1, wherein the connection features of the first strap, the connection features of the second strap, and the connection features of the third strap each comprise a connector that is couplable to connection points located on the first strap, the second strap, and the third strap.

4. The support harness of claim 3, wherein the connection points comprise a first strip of material coupled to the first strap, a second strip of material coupled to the second strap, and a third strip of material coupled to the third strap, each of the first strip of material, the second strip of material, and the third strip of material forming banded loops that are shaped and sized to receive a respective connector.

5. The support harness of claim 3, wherein the connection points comprise a plurality of through holes disposed on each of the first strap, the second strap, and the third strap, the plurality of through holes shaped and sized to receive a respective connector.

6. The support harness of claim 1, further comprising a first loop extending from the proximal end of the first strap and a second loop extending from the proximal end of the second strap, the first loop and the second loop each providing a connection point with a sling bar.

7. The support harness of claim 1, wherein the third strap extends in a system vertical direction, the first strap extends at a first angle relative to the system vertical direction, and the second strap extends at a second angle relative to the system vertical direction.

8. The support harness of claim 1, wherein a length of the first strap is substantially the same as a length of the second strap.

9. The support harness of claim 1, wherein a length of the third strap is longer than one or more of a length of the first strap and a length of the second strap.

10. The support harness of claim 1, wherein each of the plurality of straps comprises a first major surface constructed of or coated with a high-friction material and a second major surface constructed of or coated with a low-friction material, the low-friction material having a coefficient of friction that is lower than a coefficient of friction of the high-friction material, wherein the support harness is arranged such that the first major surfaces face the subject and the second major surface faces a support surface on which the subject is laying.

11. The support harness of claim 1, further comprising indicia indicating an arrangement of the plurality of straps with respect to the subject.

12. The support harness of claim 1, further comprising at least one support plate positioned on at least one of the plurality of straps.

13. The support harness of claim 12, wherein the at least one support plate is removable from the at least one of the plurality of straps.

14. The support harness of claim 12, wherein the at least one support plate is a planar component having a first major surface and a second major surface opposite the first major surface, the first major surface comprising a support pad thereon, and the second major surface comprising a retention component, the retention component receiving the at least one of the plurality of straps.

15. The support harness of claim 14, wherein the support pad is constructed of a shock absorbing material.

16. A system comprising:

an overhead lift;

a sling bar coupled to the overhead lift; and a support harness couplable to the sling bar, the support harness comprising:

a plurality of straps comprising:

a first strap having a distal end and a proximal end, the first strap having connection features that connect the distal end to a portion of the first strap;

a second strap having a distal end and a proximal end, the second strap having connection features that connect the distal end to a portion of the second strap; and a third strap having a distal end and a proximal end, the third strap having connection features that connect the distal end to a portion of the third strap, the plurality of straps arranged such that the first strap, the second strap, and the third strap are spaced apart from one another, and the third strap extends between the first strap and the second strap;

a first connection piece extending between the proximal end of the first strap and the proximal end of the third strap, the first connection piece coupling the first strap to the third strap; and a second connection piece extending between the proximal end of the second strap and the proximal end of the third strap, the second connection piece coupling the second strap to the third strap, wherein the third strap is supported by the first strap and the second strap via the first connection piece and the second connection piece, and wherein the first strap, the second strap, and the third strap are each positionable around a horizontally positioned subject by wrapping the respective distal ends around a body part of the horizontally positioned subject and coupling the distal ends to the respective portions.

17. The system of claim 16, further comprising at least one support plate positioned on at least one of the plurality of straps.

18. The system of claim 16, further comprising a second support harness.

19. A kit of parts, comprising:

a support harness comprising:

a plurality of straps comprising:

a first strap having a distal end and a proximal end, the first strap having connection features that connect the distal end to a portion of the first strap;

a second strap having a distal end and a proximal end, the second strap having connection features that connect the distal end to a portion of the second strap; and a third strap having a distal end and a proximal end, the third strap having connection features that connect the distal end to a portion of the third strap, the plurality of straps arranged such that the first strap, the second strap, and the third strap are spaced apart from one another, and the third strap extends between the first strap and the second strap;

a first connection piece extending between the proximal end of the first strap and the proximal end of the third strap, the first connection piece coupling the first strap to the third strap; and a second connection piece extending between the proximal end of the second strap and the proximal end of the third strap, the second connection piece coupling the second strap to the third strap, wherein the third strap is supported by the first strap and the second strap via the first connection piece and the second connection piece, and wherein the first strap, the second strap, and the third strap are each positionable around a horizontally positioned subject by wrapping the respective distal ends around a body part of the horizontally positioned subject and coupling the distal ends to the respective portions; and one or more instructions for positioning the support harness with respect to the horizontally positioned subject.

20. The kit of parts of claim 19, further comprising:

a second support harness; and one or more instructions for positioning the second support harness with respect to the horizontally positioned subject.

* * * * *